US008181320B2

(12) United States Patent
Wolfberg

(10) Patent No.: US 8,181,320 B2
(45) Date of Patent: May 22, 2012

(54) LACE ADJUSTER

(75) Inventor: Darren Wolfberg, New York, NY (US)

(73) Assignee: Flyclip, LLC, New York, NY (US)

( * ) Notice: Subject to any disclaimer, the term of this patent is extended or adjusted under 35 U.S.C. 154(b) by 590 days.

(21) Appl. No.: 12/366,470

(22) Filed: Feb. 5, 2009

(65) Prior Publication Data

US 2009/0223085 A1 Sep. 10, 2009

Related U.S. Application Data

(60) Provisional application No. 61/063,928, filed on Feb. 6, 2008.

(51) Int. Cl.
*A43C 7/00* (2006.01)
*F16G 11/10* (2006.01)

(52) U.S. Cl. ..... 24/712.5; 24/115 G; 36/50.1

(58) Field of Classification Search ..... 24/115 G, 24/712.1, 712.2, 712.5, 712.7; 36/50.1
See application file for complete search history.

(56) References Cited

U.S. PATENT DOCUMENTS 2,457,195 A * 12/1948 Bagnall, Jr. ..... 24/115 G
5,345,657 A 9/1994 Shimizu
5,649,340 A 7/1997 Ida
6,178,606 B1 * 1/2001 Glendon ..... 24/712.5
6,327,751 B1 12/2001 Keda
6,453,525 B1 * 9/2002 Liu ..... 24/712.5
2004/0221433 A1 11/2004 Wolfberg
2008/0115334 A1 * 5/2008 Chen et al. ..... 24/115 G

OTHER PUBLICATIONS

International Search Report and Written Opinion for PCT/US2009/056472, publication date Oct. 23, 2009, Flyclip LLC.
Notification of Transmittal with Preliminary Report on Patentability and Written Opinion for PCT/US2009/056472 mailed Aug. 18, 2011, Flyclip LLC.

* cited by examiner

*Primary Examiner* — Robert J Sandy
(74) *Attorney, Agent, or Firm* — Roeder & Broder LLP

(57) ABSTRACT

A lace adjuster (10) that selectively adjusts and secures a shoelace (770) of a shoe (772) includes an inner frame (12), an outer frame (14), a resilient member (16), and a bracket (18). The outer frame (14) receives at least a portion of the inner frame (12). The resilient member (16) is secured to the inner frame (12) and the outer frame (14), and allows the inner frame (12) and the outer frame (14) to move relative to each other between an unlocked configuration and a locked configuration. The bracket (18) is movable between a closed configuration and an open configuration. The bracket (18) is adapted to receive a portion of the shoelace (770) when the bracket (18) is in the open configuration, and the bracket (18) is adapted to retain a portion of the shoelace (770) when the bracket is in the closed configuration.

19 Claims, 17 Drawing Sheets

LACE ADJUSTER

RELATED INVENTIONS

This application claims priority on U.S. Provisional Application Ser. No. 61/063,928, filed Feb. 6, 2008 and entitled "LACE ADJUSTER". As far as permitted, the contents of U.S. Provisional Application Ser. No. 61/063,928 are incorporated herein by reference.

BACKGROUND

It is often necessary to adjust, tighten, and untighten the shoelaces of a shoe.

SUMMARY

The present invention is directed to a lace adjuster for selectively adjusting and securing a shoelace of a shoe, the shoelace including a first end and a second end. The lace adjuster includes an inner frame, an outer frame and a resilient member. The outer frame receives at least a portion of the inner frame. The resilient member is secured to the inner frame and the outer frame, and allows the inner frame and the outer frame to move relative to each other between an unlocked configuration and a locked configuration. The inner frame includes a first inner frame aperture and a spaced apart second inner frame aperture. The outer frame includes a first outer frame aperture and a spaced apart second outer frame aperture.

The first inner frame aperture and the first outer frame aperture are substantially aligned with each other when the inner frame and the outer frame are in the unlocked configuration, and the first inner frame aperture and the first outer frame aperture are not aligned with each other when the inner frame and the outer frame are in the locked configuration. The first inner frame aperture and the first outer frame aperture are adapted to receive the first end of the shoelace. Somewhat similarly, the second inner frame aperture and the second outer frame aperture are substantially aligned with each other when the inner frame and the outer frame are in the unlocked configuration, and the second inner frame aperture and the second outer frame aperture are not aligned with each other when the inner frame and the outer frame are in the locked configuration. The second inner frame aperture and the second outer frame aperture are adapted to receive the second end of the shoelace. With this design, the lace adjuster can easily and quickly tighten or loosen the shoelace of the shoe.

The first end of the shoelace is threaded through the first inner frame aperture and the first outer frame aperture when the inner frame and the outer frame are in the unlocked configuration. Additionally, the first end of the shoelace is inhibited from being moved within the first inner frame aperture and the first outer frame aperture when the inner frame and the outer frame are in the locked configuration. Somewhat similarly, the second end of the shoelace is threaded through the second inner frame aperture and the second outer frame aperture when the inner frame and the outer frame are in the unlocked configuration. Additionally, the second end of the shoelace is inhibited from being moved within the second inner frame aperture and the second outer frame aperture when the inner frame and the outer frame are in the locked configuration.

In one embodiment, the inner frame further includes a third inner frame aperture and a fourth inner frame aperture and the outer frame includes a third outer frame aperture and a fourth outer frame aperture. In this embodiment, the third inner frame aperture and the third outer frame aperture are substantially aligned with each other when the inner frame and the outer frame are in the unlocked configuration, and the third inner frame aperture and the third outer frame aperture are not aligned when the inner frame and the outer frame are in the locked configuration. Further, the first end of the shoelace is threaded through the third inner frame aperture and the third outer frame aperture when the inner frame and the outer frame are in the unlocked configuration, and the first end of the shoelace is inhibited from being moved within the third inner frame aperture and the third outer frame aperture when the inner frame and the outer frame are in the locked configuration. Additionally, the fourth inner frame aperture and the fourth outer frame aperture are substantially aligned with each other when the inner frame and the outer frame are in the unlocked configuration, and the fourth inner frame aperture and the fourth outer frame aperture are not aligned when the inner frame and the outer frame are in the locked configuration. Further, the second end of the shoelace is threaded through the fourth inner frame aperture and the fourth outer frame aperture when the inner frame and the outer frame are in the unlocked configuration, and the second end of the shoelace is inhibited from being moved within the fourth inner frame aperture and the fourth outer frame aperture when the inner frame and the outer frame are in the locked configuration.

In some embodiments, the lace adjuster further includes a bracket that is movable between a closed configuration and an open configuration. The bracket is adapted to receive a portion of the shoelace when the bracket is in the open configuration. Further, the bracket is adapted to retain a portion of the shoelace when the bracket is in the closed configuration.

In one such embodiment, a gap is defined between the bracket and the outer frame. In this embodiment, a portion of the shoelace can be inserted into or removed from the gap when the bracket is in the open configuration. Additionally, a portion of the shoelace is retained within the gap when the bracket is in the closed configuration.

Moreover, in some embodiments, the lace adjuster includes an attachment system that slidably attaches the bracket to the outer frame. This allows the bracket to move between the closed configuration and the open configuration relative to the outer frame.

In one such embodiment, the attachment system includes a pair of attacher slots, a pair of attacher apertures, and a pair of attacher pins. Each of the attacher pins extends through one of the attacher slots and one of the attacher apertures to slidably attach the bracket to the outer frame.

Further, the present invention is also directed to a shoe, and a method for selectively adjusting and securing a shoelace of a shoe.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
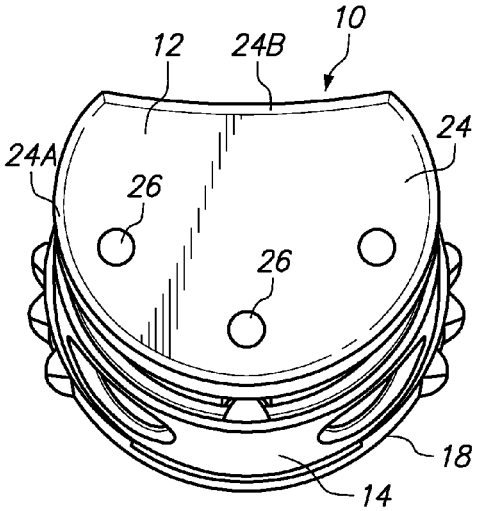
FIGS. 1A-1D are alternative views of a first embodiment of a lace adjuster having features of the present invention, wherein an inner frame and an outer frame are in a locked configuration, and wherein a bracket is in a closed configuration.
Figure 1B:
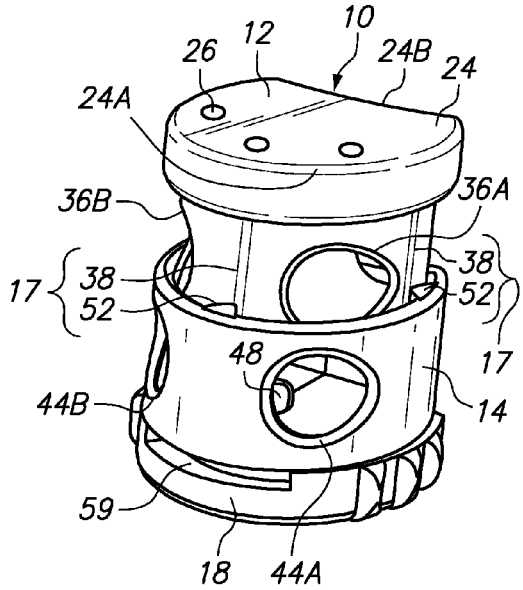
Figure 1C:
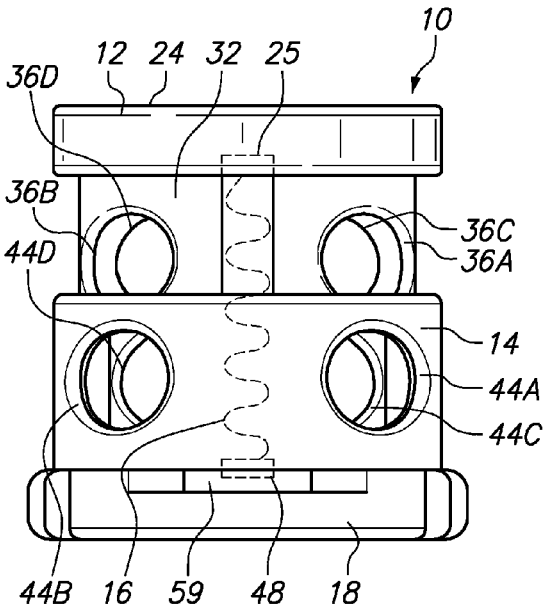
Figure 1D:
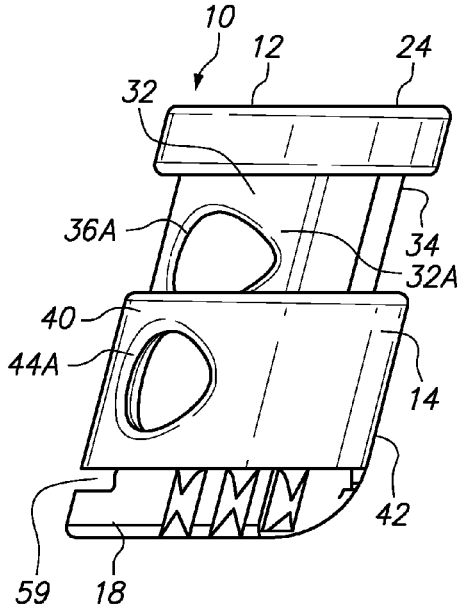

FIGS. 1A-1H are alternative views and configurations of a first embodiment of a lace adjuster 10 having features of the present invention. In this embodiment, the lace adjuster 10 includes an inner frame 12, an outer frame 14, a resilient member 16 (illustrated in phantom in FIGS. 1C and 1F), a guide system 17, a bracket 18, an attachment system 20 (illustrated in FIG. 1H), and a cover 22 (illustrated in FIG. 1H). The cover 22 has been omitted from FIGS. 1A-1G for purposes of clarity. The design and positioning of each of the components of the lace adjuster 10 can be varied pursuant to the teachings provided herein. Additionally, the lace adjuster 10 can be designed without one or more of the components as listed above. For example, the lace adjuster 10 can be designed without the guide system 17 and/or without the cover 22.

As an overview, in certain embodiments, the lace adjuster 10 can be used to easily and quickly tighten or loosen a shoelace 770 (illustrated in FIGS. 7A-7L) of a shoe 772 (illustrated in FIGS. 7A-7L). In alternative embodiments, the size of the lace adjuster 10 can be varied to suit the requirements for different sizes of shoes 772 and different sizes of shoelaces 770. For example, in one non-exclusive embodiment, the lace adjuster 10 can be designed to have an overall height of approximately 0.75 inches, an overall width of approximately 0.5 inches, and an overall depth of approximately 0.5 inches.

Figure 1E:
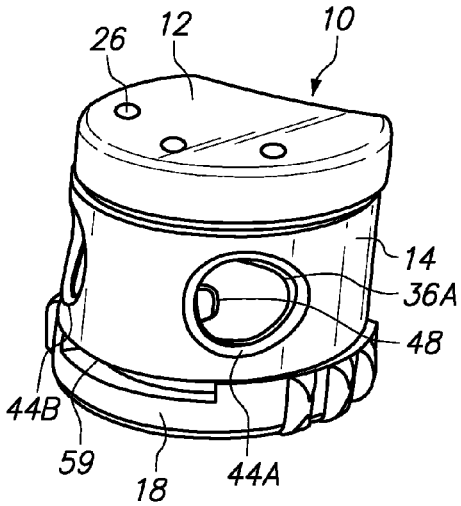
FIGS. 1E and 1F are alternative views of the lace adjuster of FIGS. 1A-1D wherein the inner frame and the outer frame have been moved to an unlocked configuration.
Figure 1F:
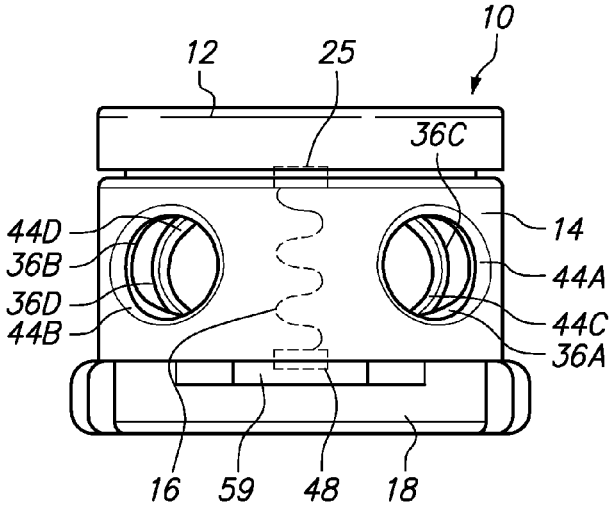
Figure 1G:
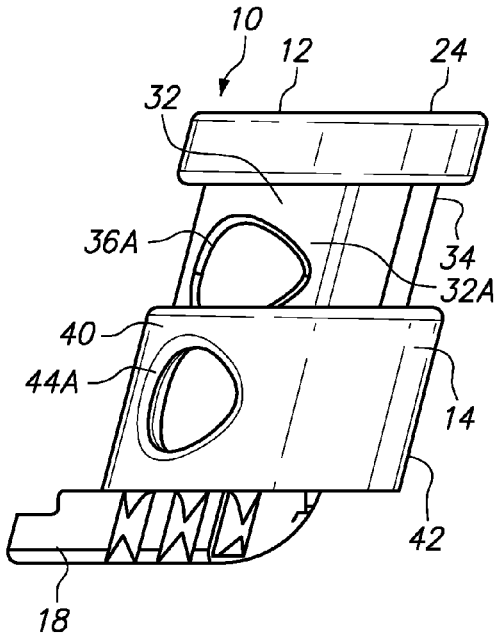
FIG. 1G is a side view of the lace adjuster of FIGS. 1A-1D wherein the bracket has been moved to an open configuration.
Figure 1H:
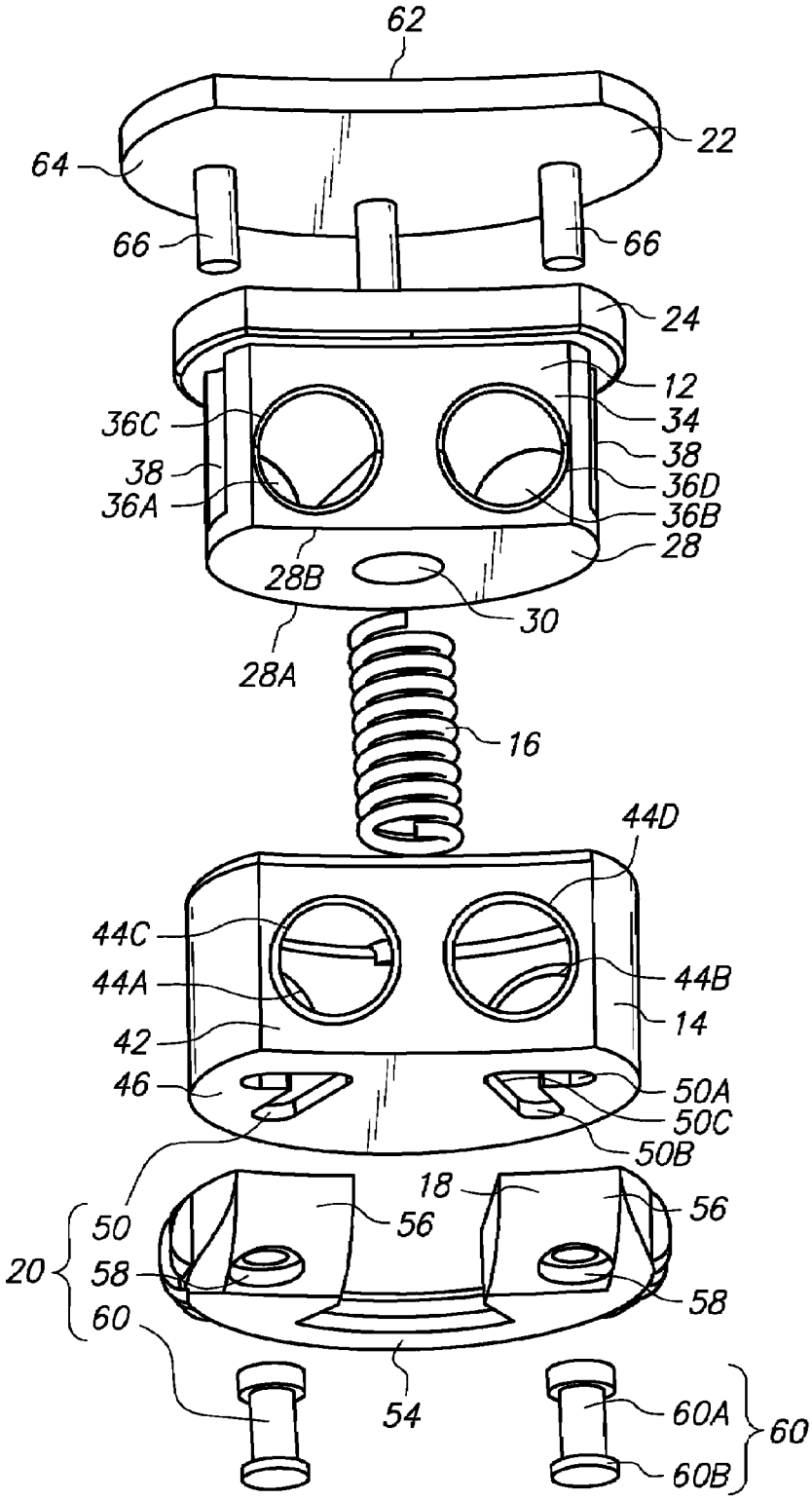
FIG. 1H is an exploded view of a cover and the lace adjuster of FIGS. 1A-1G.
Figure 2B:
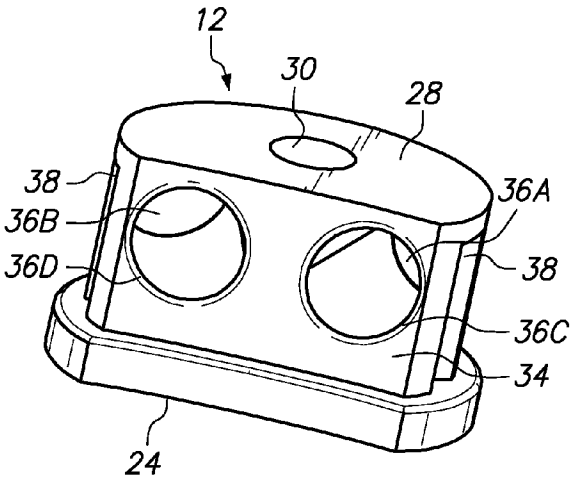
FIGS. 2A-2D are alternative views of an inner frame of the lace adjuster of FIGS. 1A-1H.
Figure 2D:
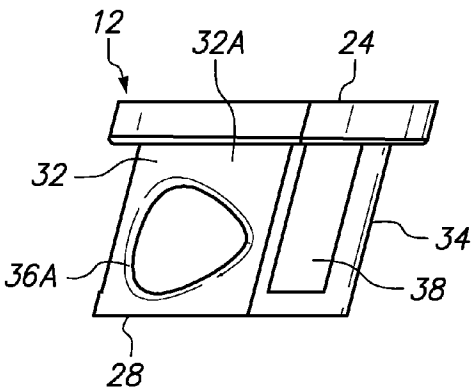
Figure 2A:
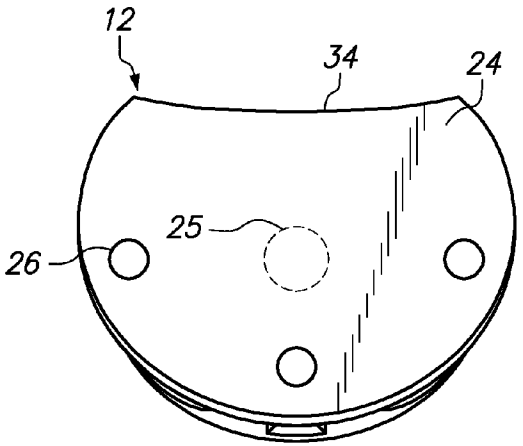
Figure 2C:
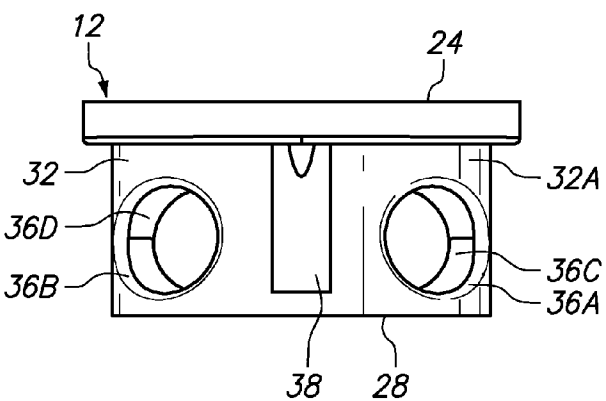
Figure 3B:
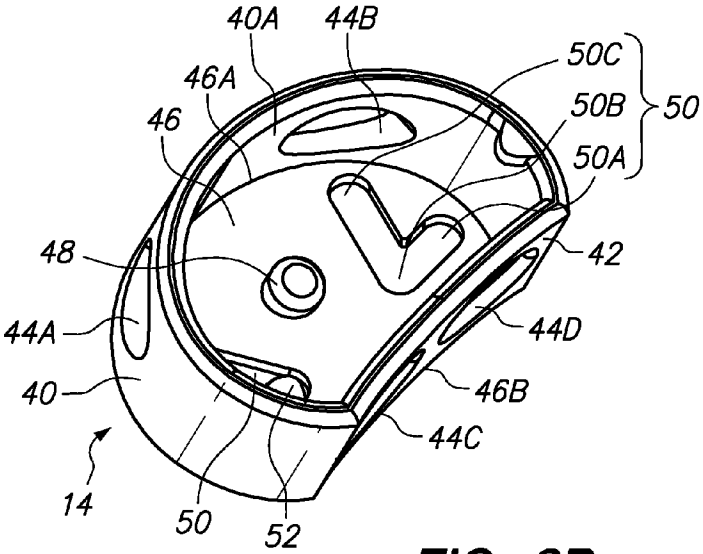
FIGS. 3A-3D are alternative views of an outer frame of the lace adjuster of FIGS. 1A-1H.
Figure 3D:
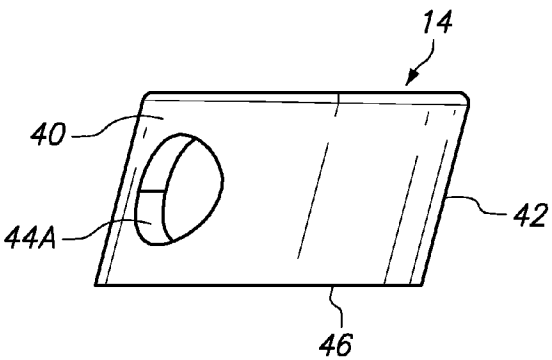
Figure 3A:
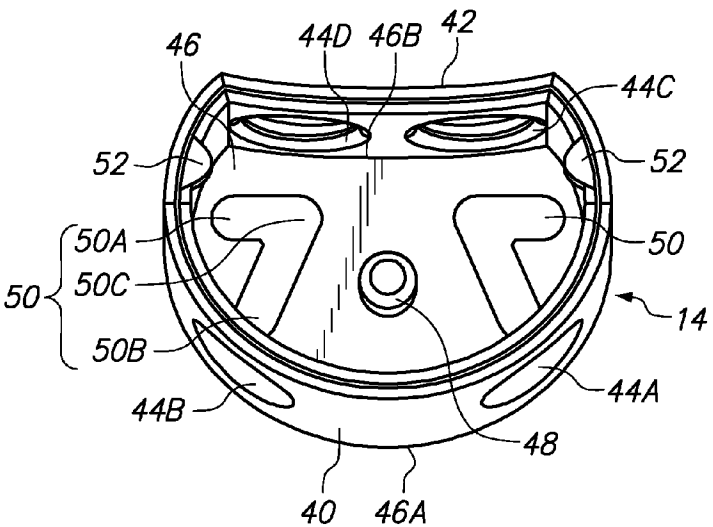
Figure 3C:
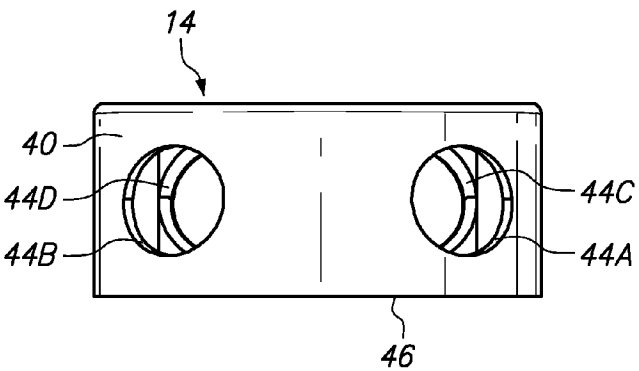

In some embodiments, some components of the lace adjuster 10 can be adjusted between different configurations in order to enable the proper functioning of the lace adjuster 10. For example, the inner frame 12 and the outer frame 14 can be moved between a locked configuration (as illustrated in FIGS. 1A-1D and 1G) and an unlocked configuration (as illustrated in FIGS. 1E and 1F). Further, the bracket 18 can be moved between a closed configuration (as illustrated in FIGS. 1A-1F) and an open configuration (as illustrated in FIG. 1G). More particularly, FIGS. 1A-1D are alternative views of a first embodiment of a lace adjuster 10 having features of the present invention, wherein the inner frame 12 and the outer frame 14 are in the locked configuration, and wherein the bracket 18 is in the closed configuration; FIGS. 1E and 1F are alternative views of the lace adjuster 10 of FIGS. 1A-1D wherein the inner frame 12 and the outer frame 14 have been moved to the unlocked configuration; and FIG. 1G is a side view of the lace adjuster 10 of FIGS. 1A-1D wherein the bracket 18 has been moved to the open configuration. Additionally, FIG. 1H is an exploded view of the lace adjuster of FIGS. 1A-1G.

In the embodiment illustrated in FIGS. 1A-1H, the inner frame 12 fits partly within and moves up and down relative to the outer frame 14. The design and positioning of the inner frame 12 can be varied depending on the requirements of the lace adjuster 10. In this embodiment, the inner frame 12 includes: (i) a top side 24 having a member receiver 25 (illustrated in phantom in FIG. 1C) and a plurality of spaced apart cover apertures 26; (ii) a bottom side 28 having a member aperture 30 (illustrated in FIG. 1H); (iii) a front side 32 having a first inner frame aperture 36A and a spaced apart second inner frame aperture 36B; (iv) a back side 34 having a third inner frame aperture 36C and a spaced apart fourth inner frame aperture 36D; and (v) a plurality of guide slots 38. Additionally, FIGS. 2A-2D are alternative views of the inner frame 12 of the lace adjuster 10 of FIGS. 1A-1H. It should be noted that the use of the terms first through fourth for the inner frame apertures 36A-36D is done for convenience only, and that any of the inner frame apertures 36A-36D can be labeled as the "first inner frame aperture", the "second inner frame aperture", the "third inner frame aperture", and the "fourth inner frame aperture".

As illustrated in FIGS. 1A-1H, the inner frame 12 is positioned substantially above the outer frame 14. Alternatively, the inner frame 12 can be positioned substantially beneath the outer frame 14 without altering the general functioning of the lace adjuster 10 of the present invention.

The top side 24 is substantially semi-circular disc shaped, with a front edge 24A that is substantially semi-circular shaped and a back edge 24B that is substantially flat, wherein the back edge 24B is designed to face the shoe 772 so as to allow the lace adjuster 10 to rest stably against the shoe 772. As illustrated, the top side 24 has a similar shape as the bottom side 28 of the inner frame 12, with the top side 24 being slightly larger than the bottom side 28. Alternatively, the top side 24 can be designed with a different shape. For example, the top side 24 can be substantially circular disc shaped, substantially square disc shaped, or substantially rectangle disc shaped.

The member receiver 25 is positioned substantially centrally on the surface of the top side 24 of the inner frame 12 that faces the outer frame 14. The member receiver 25 is adapted to receive a portion of the resilient member 16 to secure the resilient member 16 to the inner frame 12.

The plurality of spaced apart cover apertures 26 are designed to receive a portion of the cover 22 to secure the cover 22 to the top side 24 of the inner frame 12. In the embodiment illustrated in FIGS. 1A-1H, the cover apertures 26 are evenly spaced apart along the perimeter of the top side 24. As illustrated, the top side 24 includes three cover apertures 26. Alternatively, the top side 24 of the inner frame 12 can be designed to include more than three or less than three cover apertures 26. Still alternatively, the top side 24 can include different features utilized to help secure the cover 22 to the top side 24 of the inner frame 12. For example, the top side 24 may include a plurality of cover pins.

The bottom side 28 is substantially semi-circular disc shaped, with a front edge 28A that is substantially semi-circular shaped and a back edge 28B that is substantially flat, wherein the back edge 28B is designed to face the shoe 772 so as to allow the lace adjuster 10 to rest stably against the shoe 772. As illustrated, the bottom side 28 has a similar shape as the top side 24 of the inner frame 12, with the bottom side 28 being slightly smaller than the top side 24. Alternatively, the bottom side 28 can be designed with a different shape. For example, the bottom side 28 can be substantially circular disc shaped, substantially square disc shaped, or substantially rectangle disc shaped.

The member aperture 30 is positioned substantially centrally on the bottom side 28 and extends fully through the bottom side 28. The member aperture 30 is adapted to receive the resilient member 16, and the member aperture 30 allows the resilient member 16 to extend between the top side 24 of the inner frame 12 and the outer frame 14.

The front side 32 of the inner frame 12 is substantially curved in shape, it cantilevers upward away from the perimeter of the front edge 28A of the bottom side 28, and it cantilevers downward away from near the perimeter of the front edge 24A of the top side 24. Alternatively, the front side 32 can be designed with a different shape and/or to extend away from the bottom side 28 and the top side 24 in a different manner and/or from a different location. As illustrated, the front side 32 of the inner frame 12 includes the first inner frame aperture 36A and the spaced apart second inner frame aperture 36B. Alternatively, the front side 32 of the inner frame 12 can be designed to include more than two or less than two inner frame apertures.

The back side 34 of the inner frame 12 is substantially flat, it cantilevers upward away from the perimeter of the back edge 28B of the bottom side 28, and it cantilevers downward away from near the perimeter of the back edge 24B of the top side 24. Alternatively, the back side 34 can be designed with a different shape and/or to extend away from the bottom side 28 and the top side 24 in a different manner and/or from a different location. As illustrated, the back side 34 of the inner frame 12 includes the third inner frame aperture 36C and the spaced apart fourth inner frame aperture 36D. Alternatively, the back side 34 of the inner frame 12 can be designed to include more than two or less than two inner frame apertures.

In the embodiment illustrated in FIGS. 1A-1H, the plurality of guide slots 38 are positioned spaced apart around an outer surface 32A of the front side 32 of the inner frame 12. The guide slots 38 form a portion of the guide system 17. The design and positioning of the guide slots 38 can be varied to suit the requirements of the lace adjuster 10. In this embodiment, the inner frame 12 includes three spaced apart guide slots 38 that are designed to receive a portion of the outer frame 14, to help in guiding the movement of the inner frame 12 relative to the outer frame 14, and to limit the amount of relative movement between the inner frame 12 and the outer frame 14. The guide slots 38 can be substantially U-shaped or substantially V-shaped or some other shape. Alternatively, the inner frame 12 can be designed with more than three or less than three guide slots 38.

In the embodiment illustrated in FIGS. 1A-1H, the outer frame 14 is designed to receive at least a portion of the inner frame 12 and to allow the inner frame 12 to move up and down over a movement range relative to the outer frame 14. The design and positioning of the outer frame 14 can be varied depending on the requirements of the lace adjuster 10. In this embodiment, the outer frame 14 includes: (i) a front side 40 having a first outer frame aperture 44A and a spaced apart second outer frame aperture 44B; (ii) a back side 42 having a third outer frame aperture 44C and a spaced apart fourth outer frame aperture 44D; (iii) a bottom side 46 having a member receiver 48 (illustrated in FIG. 1B) and a pair of attacher slots 50; and (iv) a plurality of guide tabs 52. Additionally, FIGS. 3A-3D are alternative views of the outer frame 14 of the lace adjuster 10 of FIGS. 1A-1H. It should be noted that the use of the terms first through fourth for the outer frame apertures 44A-44D is done for convenience only, and that any of the outer frame apertures 44A-44D can be labeled as the "first outer frame aperture", the "second outer frame aperture", the "third outer frame aperture", and the "fourth outer frame aperture".

As illustrated in FIGS. 1A-1H, the outer frame 14 is positioned substantially beneath the inner frame 12. Alternatively, the outer frame 14 can be positioned substantially above the inner frame 12 without altering the general functioning of the lace adjuster 10 of the present invention.

The front side 40 of the outer frame 14 is substantially curved in shape, and it cantilevers upward away from the perimeter of a portion of the bottom side 46. Alternatively, the front side 40 can be designed with a different shape and/or to extend away from the bottom side 46 in a different manner and/or from a different location. As illustrated, the front side 40 of the outer frame 14 includes the first outer frame aperture 44A and the spaced apart second outer frame aperture 44B. Alternatively, the front side 40 of the outer frame 14 can be designed to include more than two or less than two outer frame apertures.

The back side 42 of the outer frame 14 is substantially flat, and it cantilevers upward away from the perimeter of a portion of the bottom side 46. Alternatively, the back side 42 can be designed with a different shape and/or to extend away from the bottom side 46 in a different manner and/or from a different location. As illustrated, the back side 42 of the outer frame 14 includes the third outer frame aperture 44C and the spaced apart fourth outer frame aperture 44D. Alternatively, the back side 42 of the outer frame 14 can be designed to include more than two or less than two outer frame apertures.

The bottom side 46 is substantially semi-circular disc shaped, with a front edge 46A that is substantially semi-circular shaped and a back edge 46B that is substantially flat, wherein the back edge 46B is designed to face the shoe 772 so as to allow the lace adjuster 10 to rest stably against the shoe 772. As illustrated, the bottom side 46 has a similar shape as the bottom side 28 of the inner frame 12, with the bottom side 46 of the outer frame 14 being slightly larger than the bottom side 28 of the inner frame 12, so as to allow the inner frame 12 to move within and relative to the outer frame 14. Alternatively, the bottom side 46 can be designed with a different shape. For example, the bottom side 46 can be substantially circular disc shaped, substantially square disc shaped, or substantially rectangle disc shaped.

The member receiver 48 is positioned substantially centrally on the surface of the bottom side 46 of the outer frame 14 that faces the inner frame 12. The member receiver 48 is adapted to receive a portion of the resilient member 16 to secure the resilient member 16 to the outer frame 14.

The attacher slots 50 extend through the bottom side 46 of the outer frame 14, and the attacher slots 50 form a portion of the attachment system 20. The design and positioning of the attacher slots 50 can be varied to suit the requirements of the lace adjuster 10. As illustrated in FIG. 1H, the attacher slots 50 are somewhat "L" shaped, including a lower part 50A, an upper part 50B, and an elbow part 50C that connects the lower part 50A and the upper part 50B, and the attacher slots 50 are positioned substantially symmetrically along the bottom side 46 of the outer frame 14.

In the embodiment illustrated in FIGS. 1A-1H, the plurality of guide tabs 52 are positioned spaced apart around an inner surface 40A of the front side 40 of the outer frame 14. The guide tabs 52 form a portion of the guide system 17. The design and positioning of the guide tabs 52 can be varied to suit the requirements of the lace adjuster 10. In this embodiment, the outer frame 14 includes three spaced apart guide tabs 52 that are designed to be positioned within the plurality of guide slots 38 of the inner frame 12 and to help in guiding the movement of the inner frame 12 relative to the outer frame 14. The guide tabs 38 can be substantially U-shaped or substantially V-shaped or some other shape. Alternatively, the outer frame 14 can be designed with more than three or less than three guide tabs 52.

As noted above, the inner frame 12 and the outer frame 14 are designed to move relative to each other between a locked configuration and an unlocked configuration. In the unlocked configuration, the inner frame apertures 36A-36D are substantially aligned with and concentric with the outer frame apertures 44A-44D. More particularly, in the unlocked configuration, the inner frame 12 is positioned substantially within the outer frame 14, the first inner frame aperture 36A is substantially aligned with and concentric with the first outer frame aperture 44A, the second inner frame aperture 36B is substantially aligned with and concentric with the second outer frame aperture 44B, the third inner frame aperture 36C is substantially aligned with and concentric with the third outer frame aperture 44C, and the fourth inner frame aperture 36D is substantially aligned with and concentric with the fourth outer frame aperture 44D. In the locked configuration, the inner frame 12 extends somewhat away from the outer frame 14, and the inner frame apertures 36A-36D are positioned so that they are not aligned with or concentric with the outer frame apertures 44A-44D.

The design of the resilient member 16 can be varied depending on the requirements of the lace adjuster 10. For example, in the embodiment illustrated in FIGS. 1A-1H, the resilient member 16 is a spring. Alternatively, the resilient member 16 can be another piece of resilient material. The resilient member 16 is secured to the inner frame 12 and the outer frame 14 and extends between the inner frame 12 and the outer frame 14. More particularly, the resilient member 16 is secured to the inner frame 12 via the member receiver 25, and the resilient member 16 is secured to the outer frame 14 via the member receiver 48. In this embodiment, the resilient member 16 urges the inner frame 12 up and/or away relative to the outer frame 14. Alternatively, the resilient member 16 can be designed to urge the inner frame 12 within the outer frame 14. In such alternative embodiment, the lace adjuster 10 would further require a locking mechanism that would maintain the inner frame 12 and the outer frame 14 in the locked configuration. In these alternative embodiments, the resilient member 16 is either extended or compressed as the inner frame 12 and the outer frame 14 are moved between the locked configuration and the unlocked configuration.

The guide system 17 guides the movement of the inner frame 12 (e.g. up and down) relative to the outer frame 14. The design of the guide system 17 can be varied to suit the requirements of the lace adjuster 10. In the embodiment illustrated in FIGS. 1A-1H, the guide system 17 includes the plurality of guide slots 38 and the plurality of guide tabs 52. Each of the plurality of guide slots 38 is designed and positioned to receive one of the plurality of guide tabs 52. As discussed above, the guide slots 38 can be substantially U-shaped, substantially V-shaped, or some other shape slots along the outer surface 32A of the front side 32 of the inner frame 12. Similarly, the guide tabs 52 can be substantially U-shaped, substantially V-shaped, or some other shape tabs along the inner surface 40A of the front side 40 of the outer frame 14. Alternatively, the inner frame 12 can be designed with more than three or less than three guide slots 38, and the outer frame 14 can be designed with more than three or less than three guide tabs 52. Still alternatively, the lace adjuster 10 can be designed wherein the inner frame 12 includes a plurality of guide tabs and the outer frame 14 includes a plurality of guide slots.

In the embodiment illustrated in FIGS. 1A-1H, the bracket 18 is secured to the outer frame 14, and the bracket 18 is designed to move (e.g. slide) relative to the outer frame 14 between the closed configuration and the open configuration. The design and positioning of the bracket 18 can be varied depending on the requirements of the lace adjuster 10. In this embodiment, the bracket 18 includes: (i) a front section 54; (ii) a pair of side sections 56; and (iii) a pair of attacher apertures 58. Additionally, FIGS. 4A-4D are alternative views of the bracket 18 of the lace adjuster 10 of FIGS. 1A-1H.

As illustrated in FIGS. 1A-1F, when the bracket 18 is in the closed configuration, the bracket 18 is positioned substantially directly beneath the outer frame 14. As illustrated in FIG. 1G, when the bracket 18 is in the open configuration, the bracket 18 is positioned somewhat beneath the outer frame 14, but it also extends forward away from the outer frame 14. The movement of the bracket 18 from the closed configuration to the open configuration is somewhat similar to the movement seen when a cash register drawer is opened. In alternative embodiments, the bracket 18 can be positioned substantially directly above the outer frame 14 and/or the bracket 18 can be secured to the inner frame 12.

Figure 4B:
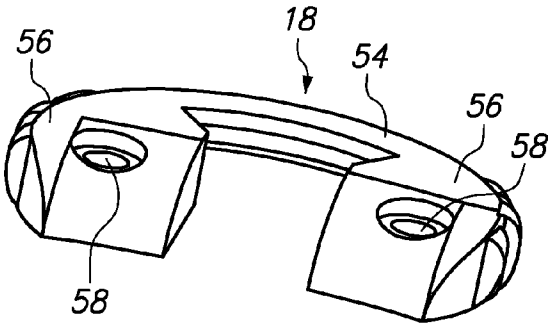
FIGS. 4A-4D are alternative views of a bracket of the lace adjuster of FIGS. 1A-1H.
Figure 4D:
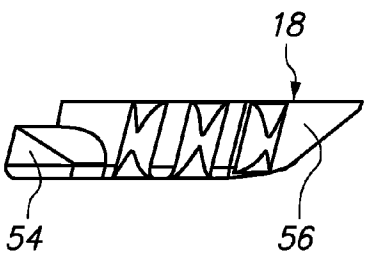

The front section 54 of the bracket 18 is substantially arc-shaped and is positioned somewhat between the pair of side sections 56 and is connected to each of the side sections 56. The front section 54 is made from a relatively thin and flexible material that allows the side sections 56 to flex toward each other when pressure is applied on the outer edges of the side sections 56. As illustrated in FIG. 4D, the front section 54 is slightly shorter than the side sections 56, so as to define a gap 59 between the bracket 18 and the outer frame 14, which, in turn, enables a portion of the shoelace to be secured within the gap 59 between the bracket 18 and the outer frame 14 when the bracket 18 is in the closed configuration.

Figure 4A:
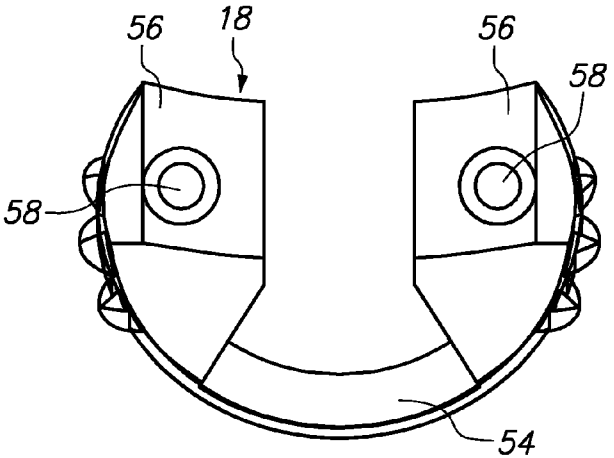
Figure 4C:
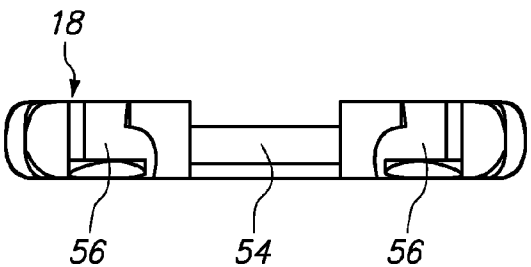

As best illustrated in FIG. 4A, each side section 56 includes one of the pair of attacher apertures 58. The attacher apertures 58 form a portion of the attachment system 20. The design and positioning of the attacher apertures 58 can be varied to suit the requirements of the lace adjuster 10. As illustrated, the attacher apertures are substantially circular and are positioned beneath a portion of the attacher slots 50 on the bottom side 46 of the outer frame 14.

In the embodiment illustrated in FIGS. 1A-1H, the attachment system 20 is designed to slidably attach the bracket 18 to the outer frame 14. The design and positioning of the attachment system 20 can be varied depending on the requirements of the lace adjuster 10. For example, in alternative embodiments, the attachment system 20 can be designed to slidably attach the bracket 18 to the inner frame 12. In such embodiments, the top side 24 of the inner frame 12 would include a pair of attacher slots.

In the present embodiment, the attachment system 20 includes the attacher slots 50 that extend through the bottom side 46 of the outer frame 14, the attacher apertures 58 that extend through the side sections 56 of the bracket 18, and a pair of attachment pins 60 that extend through the attacher slots 50 and the attacher apertures 58. Additionally, FIGS. 5A-5D are alternative views of the attachment system 20 of the lace adjuster 10 of FIGS. 1A-1H.

As discussed above, in this embodiment, the bottom side 46 of the outer frame 14 includes the pair of spaced apart, somewhat "L" shaped attacher slots 50, and the side sections 56 of the bracket 18 include the pair of substantially circular shaped attacher apertures 58, wherein each of the attacher apertures 58 correspond to one of the attacher slots 50. Further, each of the pair of attachment pins 60 extend through a corresponding attacher aperture 58 in the bracket 18 and into one of the attacher slots 50 in the outer frame 14. The attachment pins 60 are designed to fit snugly within the attacher apertures 58, and the attachment pins 60 are designed to slide within the attacher slots 50. With this design, the attachment pins 60 attach the bracket 18 to the outer frame 14, and the attachment pins 60 and the bracket 18 can slide relative to the outer frame 14 along the attacher slots 50.

When the bracket 18 is in the closed configuration, the attachment pins 60 are positioned outwardly into the lower part 50A of the "L" shaped attacher slots 50. In this closed configuration, the bracket 18 is designed so that the attachment pins 60 are biased to remain in the lower part 50A of the attacher slots 50, and the bracket 18 is easily maintained in the closed configuration. Subsequently, the user can deform the side sections 56 of the bracket 18 by flexing them inwardly toward each other and subsequently move the attachment pins 60 inwardly within the attacher slots 50 to the elbow part 50C. Next, the user can slide the bracket 18 forward relative to the outer frame 14 into the open configuration, with the attachment pins 60 consequently sliding into the upper part 50B of the "L" shaped attacher slots 50. In this open configuration, the bracket 18 is designed so that the attachment pins 60 are biased to remain in the upper part 50B of the attacher slots 50, and the bracket 18 is easily maintained in the open configuration. While the bracket 18 is in the open configuration, a portion of the shoelace 770, such as one or both of the ends of the shoelace 770, can easily be inserted into or removed from the gap 59 between the bracket 18 and the outer frame 14. Subsequently, while the bracket 18 is in the closed configuration, a portion of the shoelace 770, such as one or both ends of the shoelace 770, can be effectively clamped within the gap 59 between the bracket 18 and the outer frame 14.

Figure 5A:
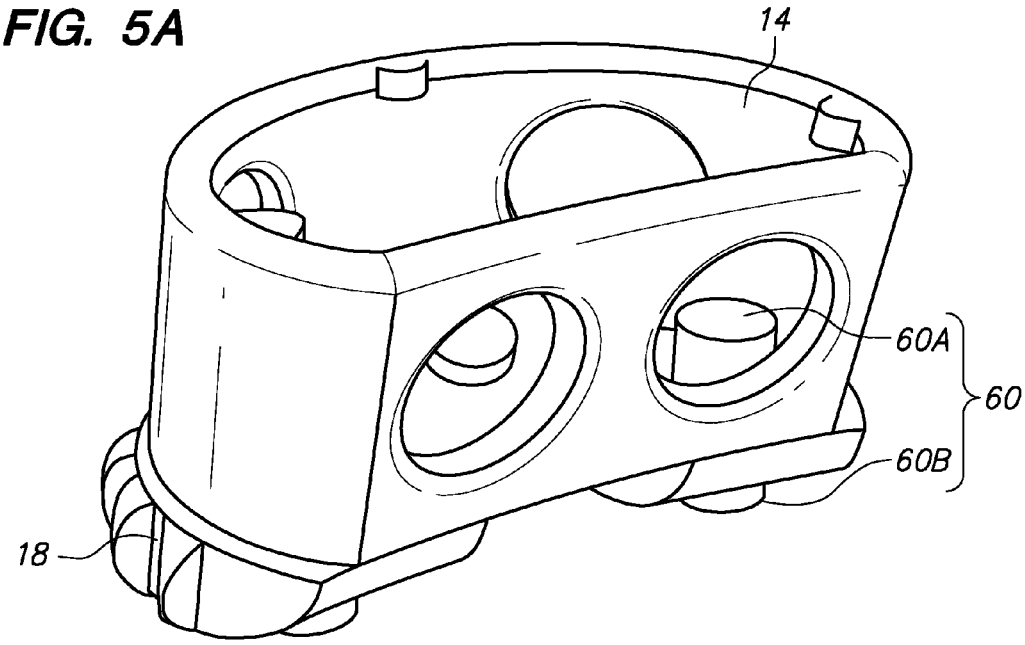
FIG. 5A-5D are alternative views of an attachment system of the lace adjuster of FIGS. 1A-1H.
Figure 5B:
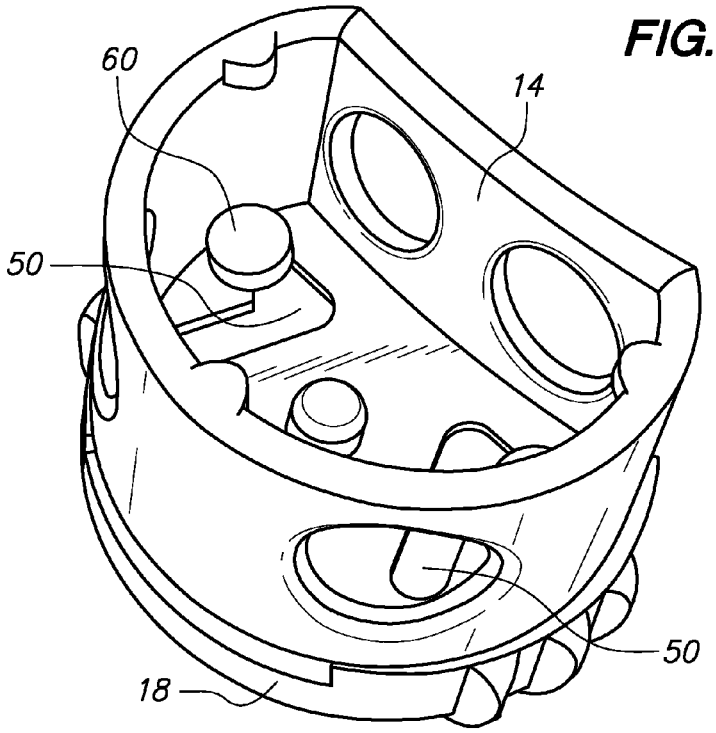
Figure 5C:
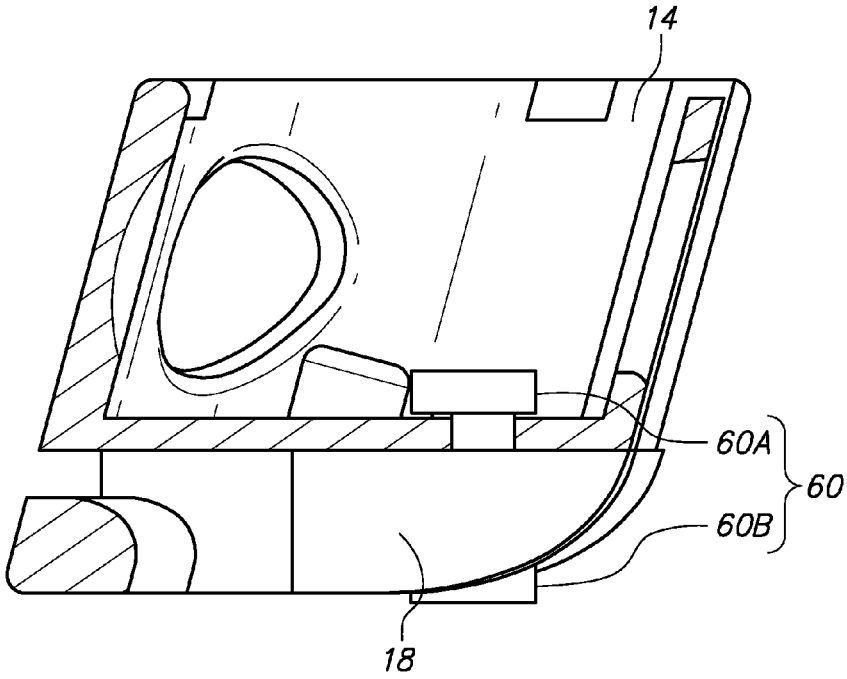
Figure 5D:
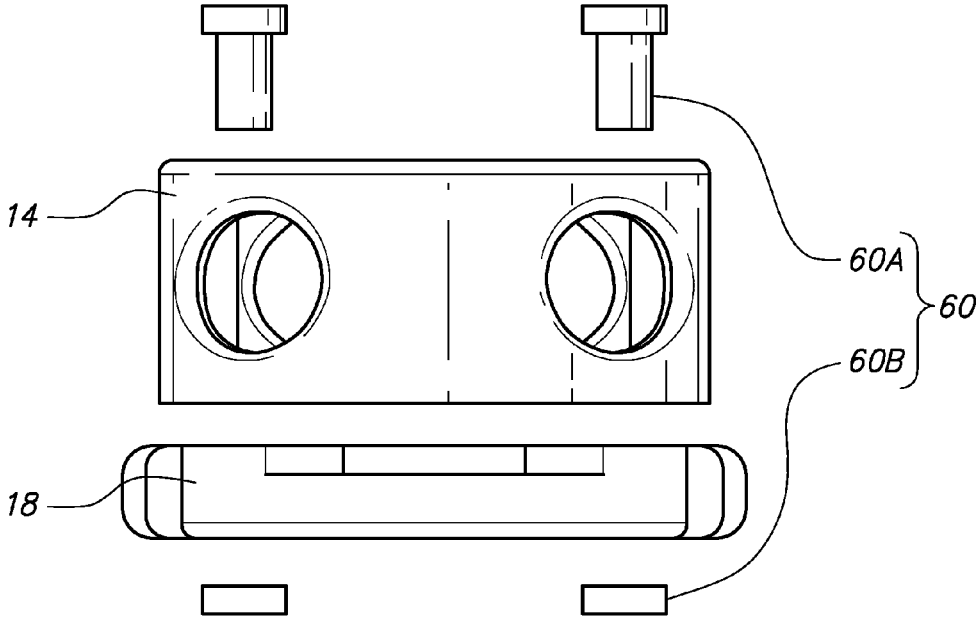
Figure 6B:
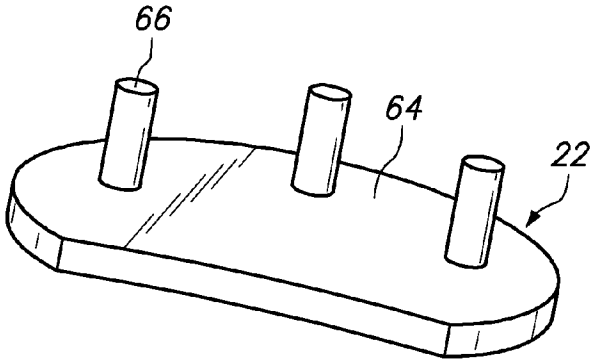
FIGS. 6A-6D are alternative views of a cover of the lace adjuster of FIGS. 1A-1H.
Figure 6D:
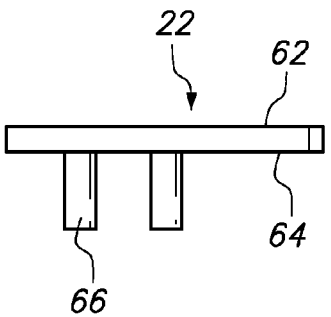
Figure 6A:
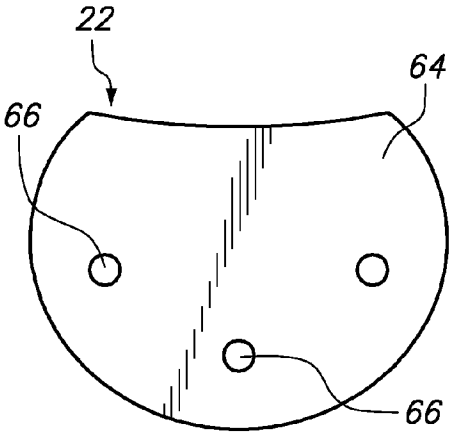
Figure 6C:
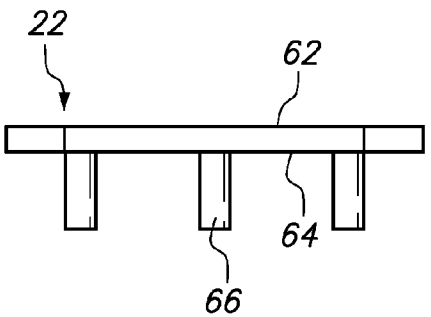

The design of the attachment pins 60 can be varied to suit the requirements of the lace adjuster 10. As best illustrated in FIG. 5D, in the present embodiment, the attachment pins 60 include a pin body 60A and a pin nut 60B that selectively engages the pin body 60A. Alternatively, the attachment pins 60 can include rigid pins that secure the bracket 18 to the outer frame 14 and that allow the bracket 18 to move and slide relative to the outer frame 14. In such embodiments, the pin nut 60B can be permanently affixed to the pin body 60A, such as by welding.

As illustrated in FIG. 1H, the cover 22 is secured to the inner frame 12. The design and positioning of the cover 22 can be varied depending on the requirements of the lace adjuster 10. For example, in alternative embodiments, the cover 22 can be secured to the outer frame 14.

As illustrated, the cover is substantially semi-circular disc shaped, very similar to the shape of the top side 24 of the inner frame. Alternatively, the cover 22 can be designed with a different shape. For example, the cover 22 can be substantially circular disc shaped, substantially square disc shaped, or substantially rectangle disc shaped. In this embodiment, the cover 22 includes: (i) a top surface 62; (ii) an opposed bottom surface 64; and (iii) a plurality of spaced apart cover pins 66. Additionally, FIGS. 5A-5D are alternative views of the cover 22 of the lace adjuster 10 of FIGS. 1A-1H. The top surface 62 faces away from the inner frame 12 and can be designed to include a logo or other design. The bottom surface 64 faces the inner frame 12 and includes the plurality of spaced apart cover pins 66. The cover pins 66 extend away from the bottom surface 64 of the cover 22, and the cover pins 66 are positioned to coincide with the cover apertures 26 that are positioned along the top side 24 of the inner frame 12. The cover apertures 26 receive the cover pins 66 so as to effectively secure the cover 22 to the inner frame 12. With this design, different covers 22 with alternative logos can be quickly and easily attached to the rest of the lace adjuster 10. In alternative embodiments, the cover 22 can be designed to include a plurality of cover apertures and the top side 24 of the inner frame 12 can be designed to include a plurality of cover pins. Still alternatively, the cover 22 can be adapted to be secured to the outer frame 14.

In summary, in the embodiment illustrated primarily in FIGS. 1A-1H, (i) the inner frame 12 fits partly within and moves up and down relative to the outer frame 14 between the locked configuration and the unlocked configuration; (ii) the resilient member 16 extends between the inner frame 12 and the outer frame 14 and urges the inner frame 12 upward; (iii) the inner frame 12 includes a first inner frame aperture 36A, a second inner frame aperture 36B, a third inner frame aperture 36C, and a fourth inner frame aperture 36D, which are each spaced apart from the other inner frame apertures; (iv) the outer frame 14 includes a first outer frame aperture 44A, a second outer frame aperture 44B, a third outer frame aperture 44C, and a fourth outer frame aperture 44D, which are each spaced apart from the other outer frame apertures; (v) the inner frame apertures 36A-36D are substantially aligned with and concentric with the outer frame apertures 44A-44D when the inner frame 12 and the outer frame 14 are in the unlocked configuration, thereby allowing the shoelace 770 to be threaded through the inner frame apertures 36A-36D and the outer frame apertures 44A-44D; (vi) the inner frame apertures 36A-36D are not aligned with and concentric with the outer frame apertures 44A-44D when the inner frame 12 and the outer frame 14 are in the locked configuration, thereby allowing the shoelace 770 to be held securely between the inner frame 12 and the outer frame 14; (vii) the bracket 18 is attached to and slides relative to the outer frame 14 via the attachment system 20 between the open configuration and the closed configuration; (viii) a portion of the shoelace 770 can be easily inserted into and/or removed from the gap 59 between the bracket 18 and the outer frame 14 when the bracket 18 is in the open configuration; and (ix) a portion of the shoelace 770 can be securely held within the gap 59 between the bracket 18 and the outer frame 14 when the bracket 18 is in the closed configuration.

FIGS. 7A-7L are a series of pictorial flowcharts that illustrate the installation, loosening, tightening, and removal of the lace adjuster 10 on a shoelace 770 of a shoe 772, wherein the shoelace includes a first end 770A and a second end 770B. It should be noted that, for purposes of clarity, certain detailed features of the lace adjuster 10 are not specifically shown, as noted below, in FIGS. 7A-7L. However, such detailed features are clearly illustrated in the above-described Figures.

Figure 7A:
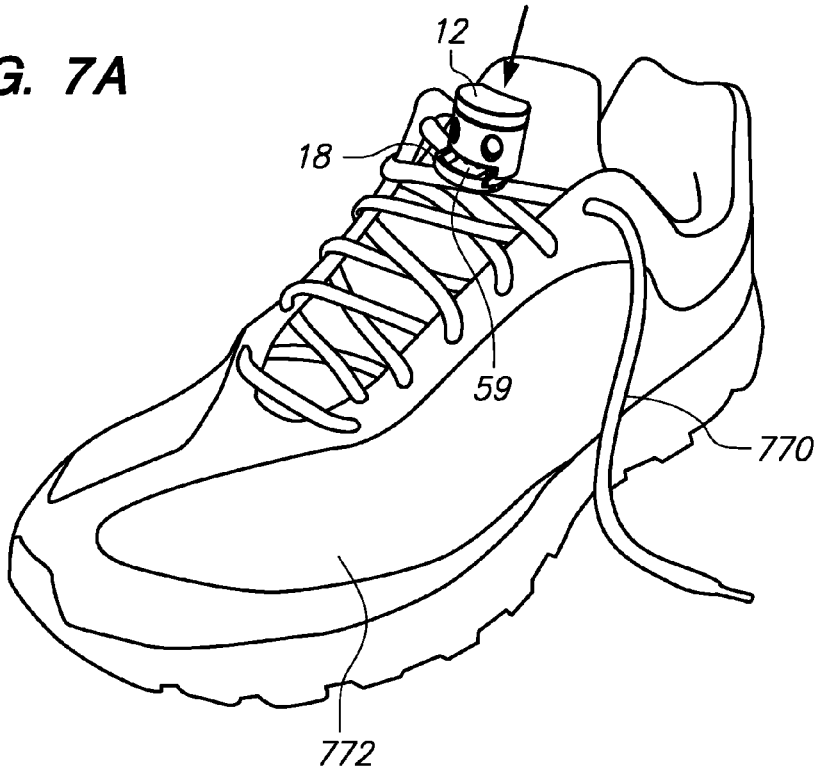
FIGS. 7A-7D are a pictorial flowchart that illustrates the installation of the lace adjuster to a shoelace of a shoe.
Figure 7B:
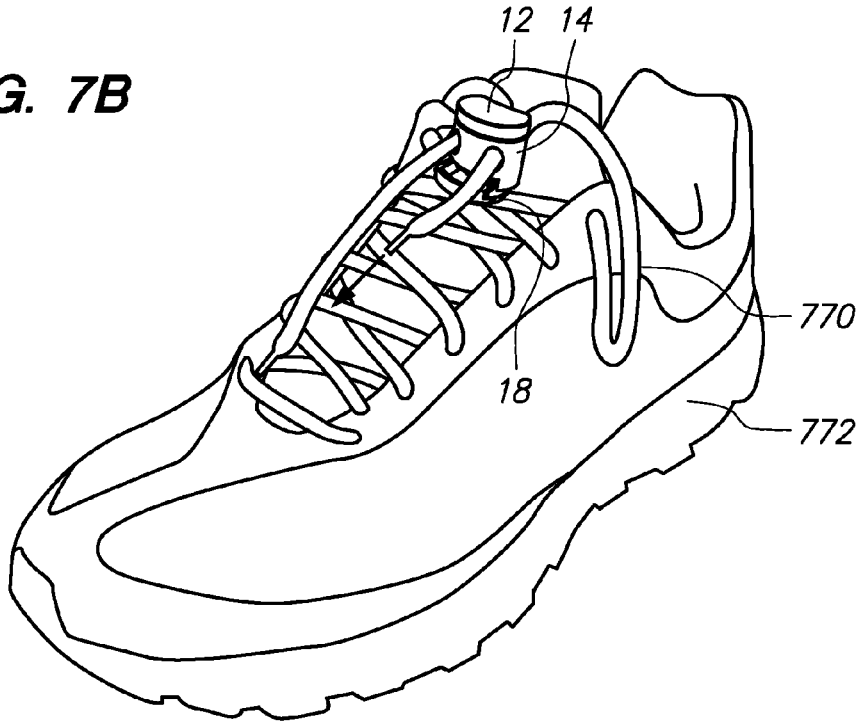

FIGS. 7A-7D are a pictorial flowchart that illustrates the installation of the lace adjuster 10 to the shoelace 770 of the shoe 772. First, as illustrated in FIG. 7A, the inner frame 12 is pushed down relative to the outer frame 14 against the urging of the resilient member 16 (not shown in FIGS. 7A-7D) so that the inner frame 12 and the outer frame 14 are in the unlocked configuration. Next, as illustrated in FIG. 7B, the first end 770A of the shoelace 770 is inserted into the third outer frame aperture 44C (not shown in FIG. 7B) and the third inner frame aperture 36C (not shown in FIG. 7B), and then inserted into the first inner frame aperture (not shown in FIG. 7B) 36A and the first outer frame aperture 44A (not shown in FIG. 7B). Subsequently, the second end 770B of the shoelace 770 is inserted into the fourth outer frame aperture 44D (not shown in FIG. 7B) and the fourth inner frame aperture 36D (not shown in FIG. 7B), and then inserted into the second inner frame aperture 36B (not shown in FIG. 7B) and the second outer frame aperture 44B (not shown in FIG. 7B). In certain embodiments, when the inner frame 12 is depressed, (i) the first inner frame aperture 36A is substantially aligned with and concentric with the first outer frame aperture 44A, (ii) the second inner frame aperture 36B is substantially aligned with and concentric with the second outer frame aperture 44B, (iii) the third inner frame aperture 36C is substantially aligned with and concentric with the third outer frame aperture 44C, (iv) the fourth inner frame aperture 36D is substantially aligned with and concentric with the fourth outer frame aperture 44D, and (v) the ends 770A, 770B of the shoelace 770 can be easily moved relative to the lace adjuster 10. Alternatively, when the inner frame 12 is not depressed, the resilient member 16 pushes the inner frame 12 upward so that the inner frame 12 and the outer frame 14 are in the locked configuration. When the inner frame 12 and the outer frame 14 are in the locked configuration, (i) the first inner frame aperture 36A is not aligned with and concentric with the first outer frame aperture 44A, (ii) the second inner frame aperture 36B is not aligned with and concentric with the second outer frame aperture 44B, (iii) the third inner frame aperture 36C is not aligned with and concentric with the third outer frame aperture 44C, (iv) the fourth inner frame aperture 36D is not aligned with and concentric with the fourth outer frame aperture 44D, and (iii) the ends 770A, 770B of the shoelace 770 are inhibited from being moved relative to the lace adjuster 10.

Figure 7C:
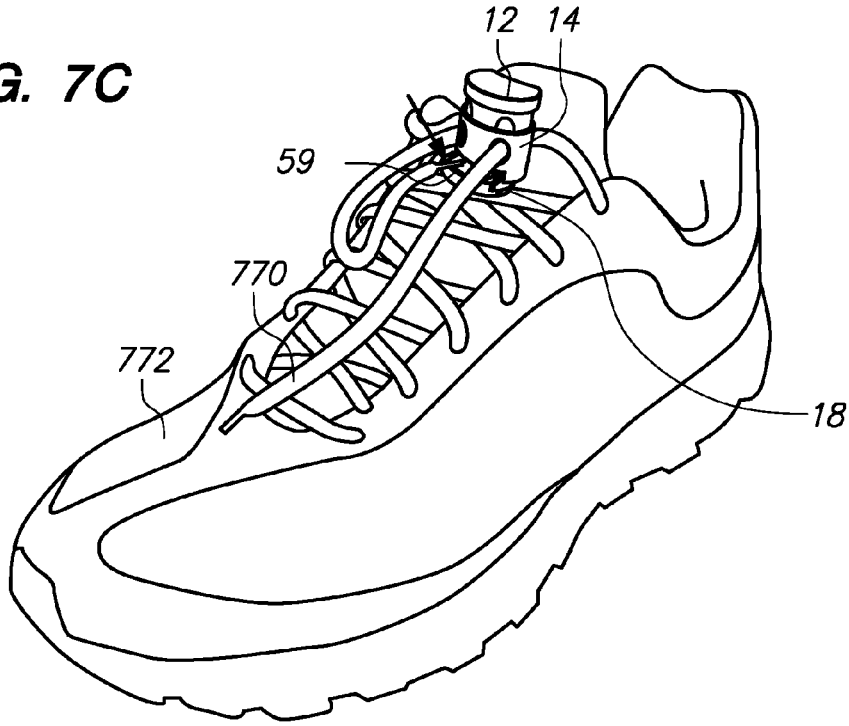
Figure 7D:
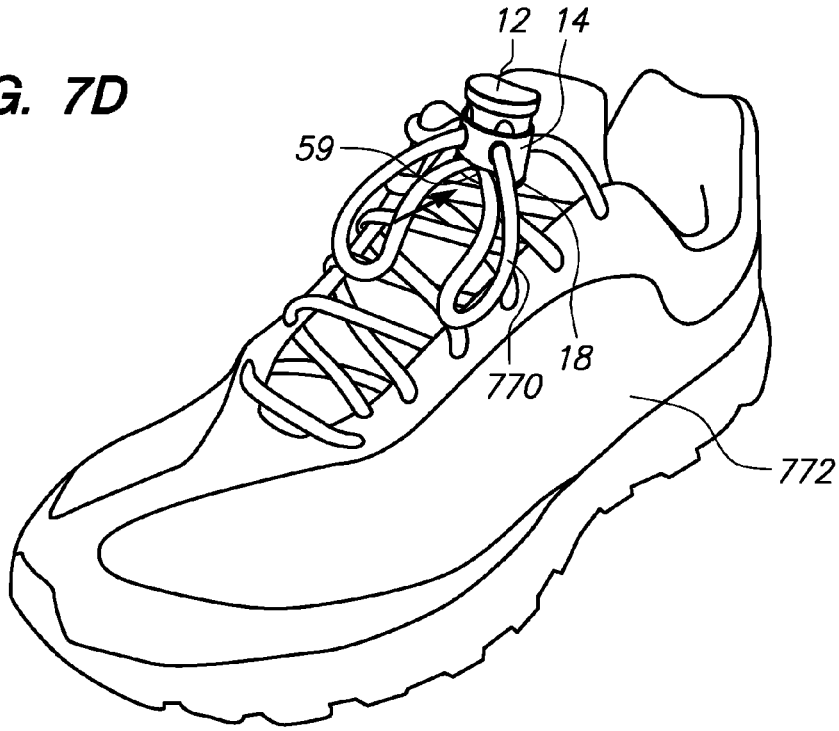

In the next step in procedure, as illustrated in FIG. 7C, the bracket 18 is slid forward relative to the outer frame 14 from the closed configuration to the open configuration and the ends 770A, 770B of the shoelace 770 are inserted into the gap 59 between the bracket 18 and the outer frame 14. Next, as illustrated in FIG. 7D, the bracket 18 is slid backward relative to the outer frame 14 from the open configuration to the closed configuration to lock/clamp the ends 770A, 770B of the shoelace 770 between the bracket 18 and the outer frame 14.

Figure 7E:
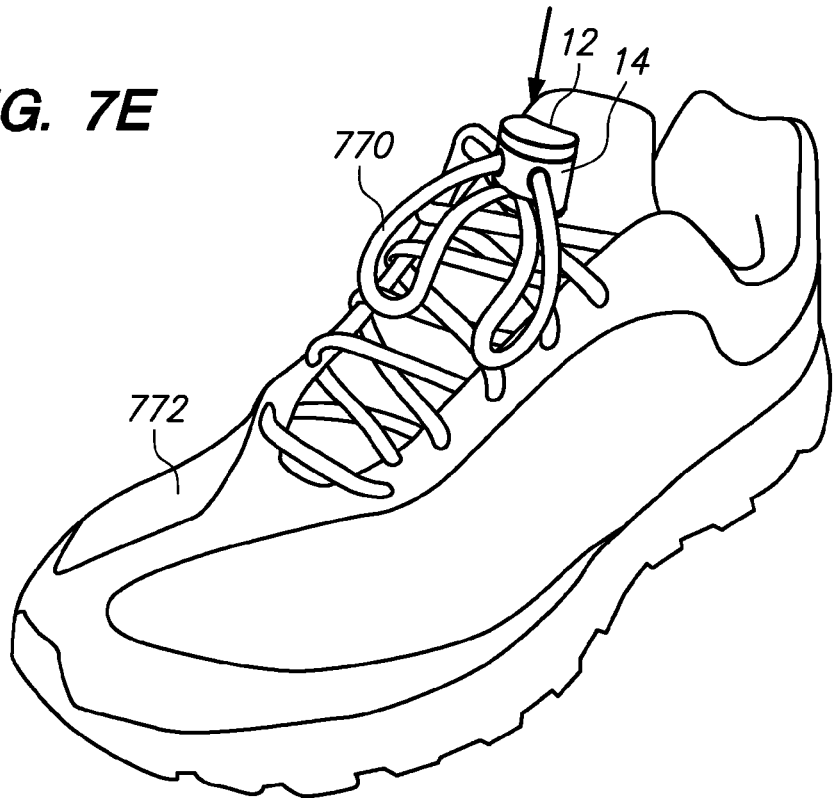
FIGS. 7E and 7F are a pictorial flowchart that illustrates the loosening of the lace adjuster to a shoelace of a shoe.
Figure 7F:
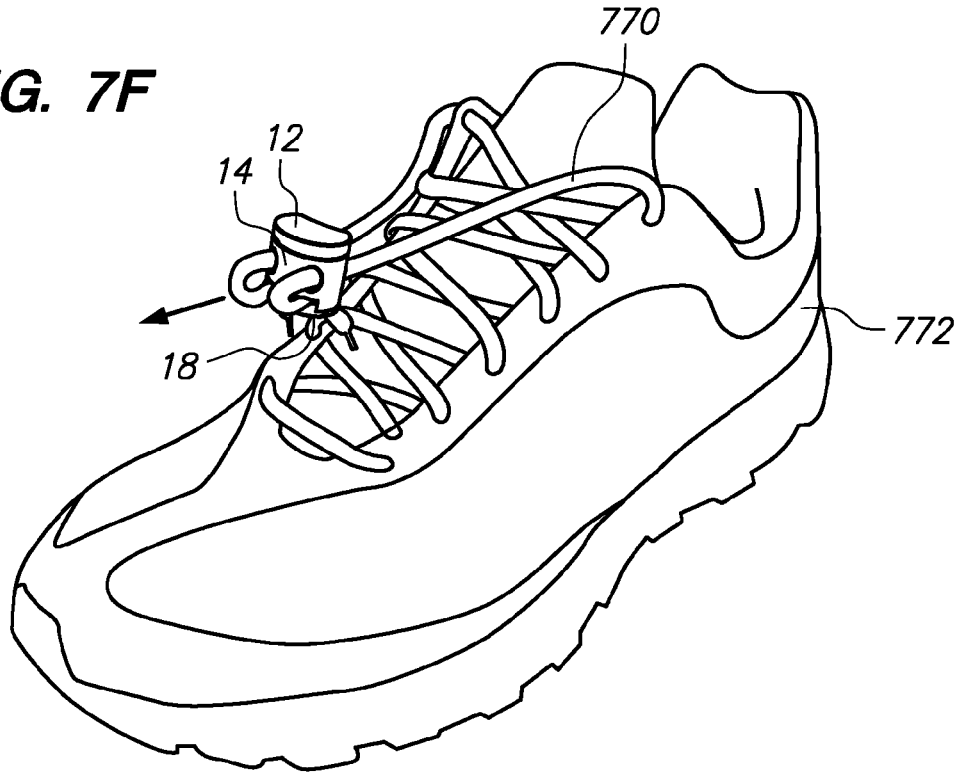

FIGS. 7E and 7F are a pictorial flowchart that illustrates loosening the shoelace 770 of the shoe 772 with the lace adjuster 10. Basically, when the inner frame 12 is depressed so that the inner frame 12 and the outer frame 14 are in the unlocked configuration, the lace adjuster 10 can be moved away from the shoe 772 to loosen the shoelace 770.

Figure 7G:
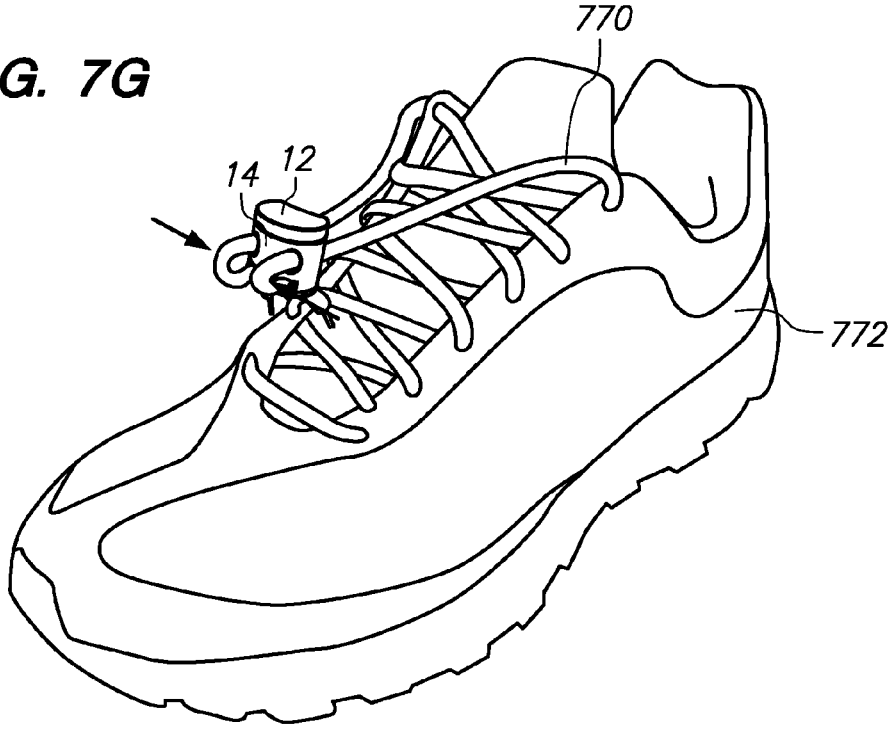
FIGS. 7G and 7H are a pictorial flowchart that illustrates the tightening of the lace adjuster to a shoelace of a shoe.
Figure 7H:
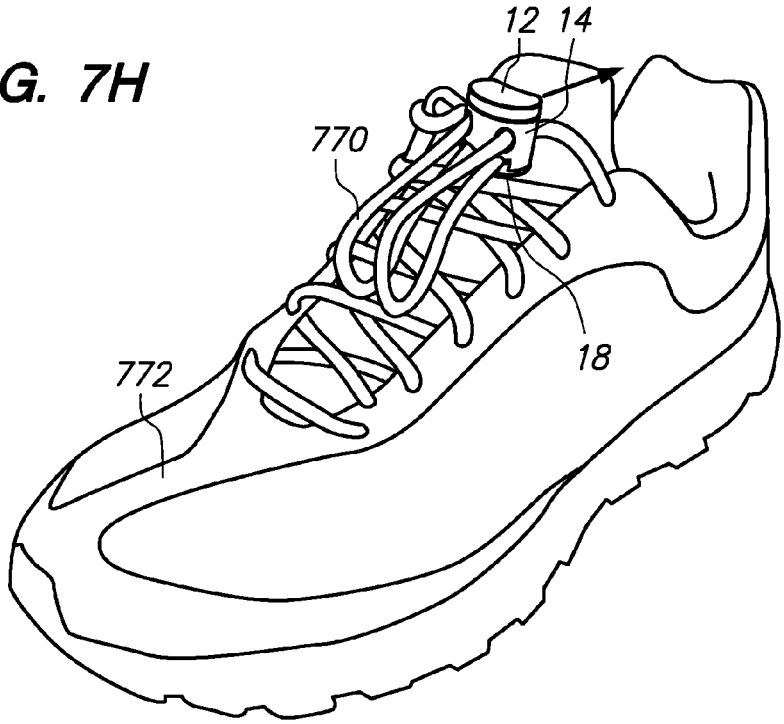

FIGS. 7G and 7H are a pictorial flowchart that illustrates tightening the shoelace 770 of the shoe 772 with the lace adjuster 10. First, the ends 770A, 770B of the shoelace 770 are held out front of the shoe 772. Next, the inner frame 12 is depressed so that the inner frame 12 and the outer frame 14 are in the unlocked configuration, and the lace adjuster 10 is moved towards the shoe 772. Finally, the inner frame 12 is released and the inner frame 12 moves upward so that the inner frame 12 and the outer frame 14 are in the locked configuration, so as to inhibit relative movement between the shoelace 770 and the lace adjuster 10.

Figure 7I:
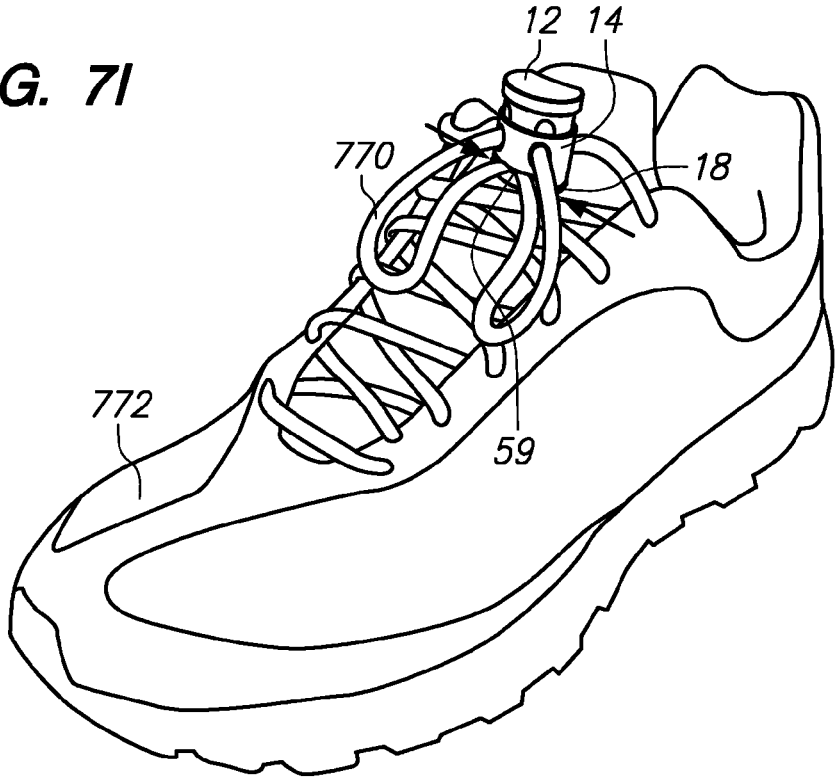
FIGS. 7I-7L are a pictorial flowchart that illustrates the removal of the lace adjuster from a shoelace of a shoe.
Figure 7J:
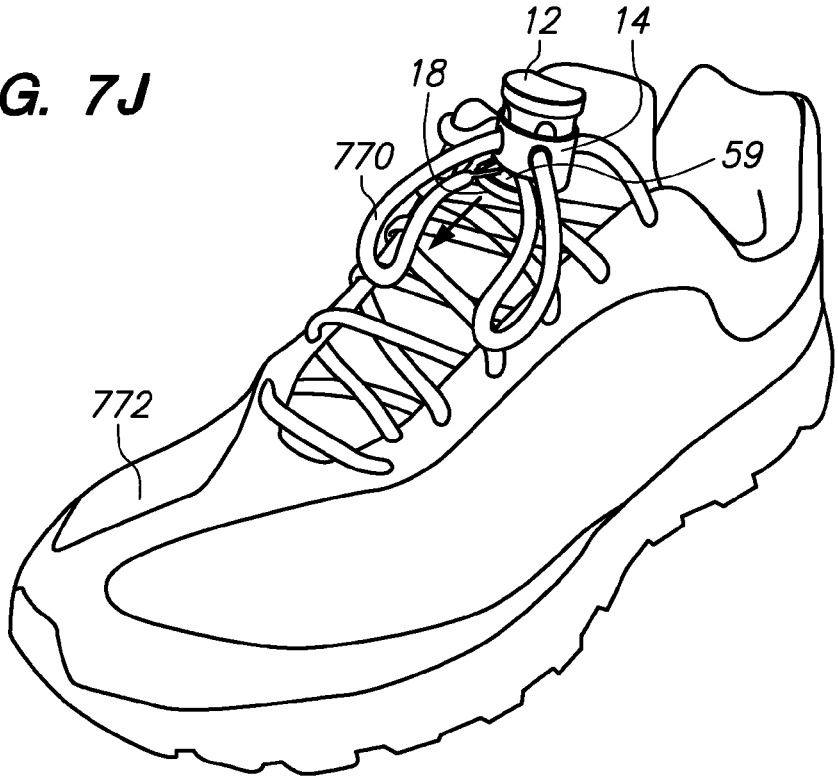
Figure 7K:
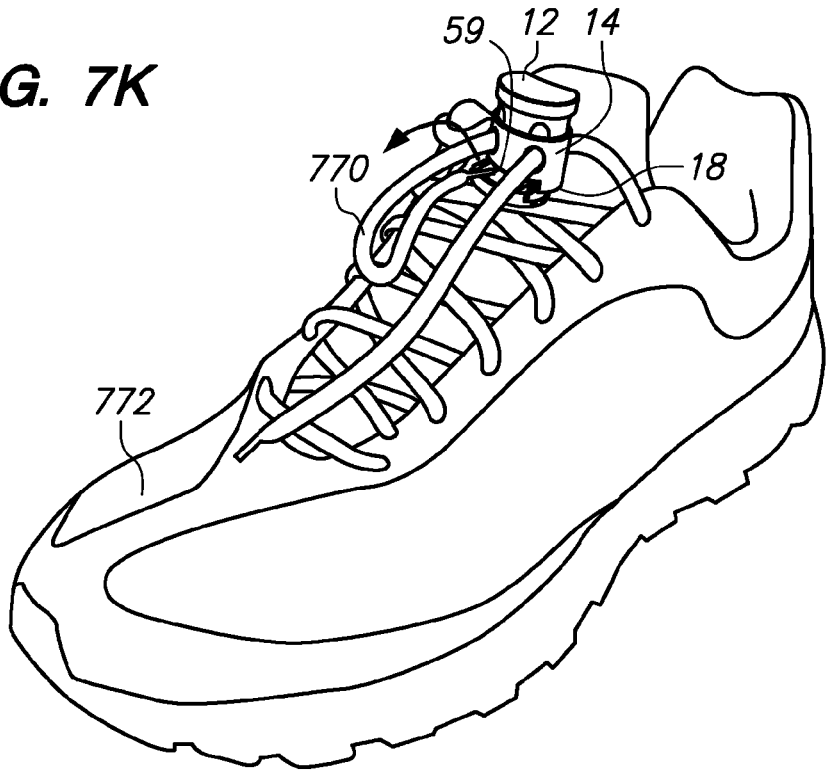
Figure 7L:
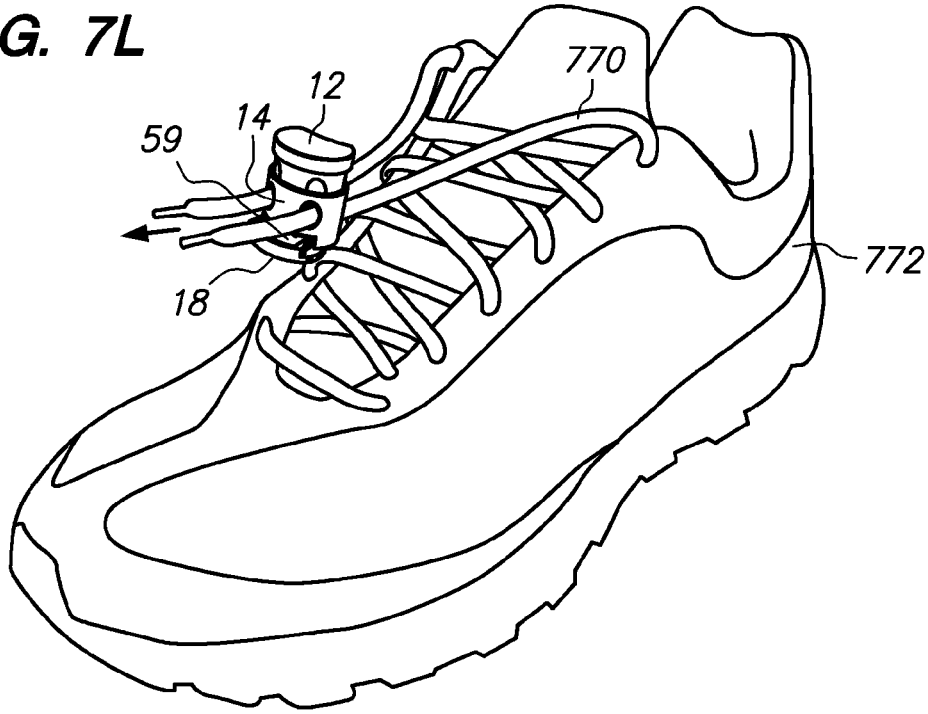

FIGS. 7I-7L are a pictorial flowchart that illustrates removal of the lace adjuster 10 from the shoelace 770 of the shoe 772. First, as illustrated in FIG. 7I, the side sections 56 (not shown in FIG. 7I) of the bracket 18 are pinched to flex the side sections 56 toward each other and bend the bracket 18. This allows the bracket 18 to slide forward relative to the outer frame 14 from the closed configuration to the open configuration. Next, as illustrated in FIG. 7J, the bracket 18 is slid forward relative to the outer frame 14 from the closed configuration to the open configuration. Subsequently, as illustrated in FIG. 7K, the ends 770A, 770B of the shoelace 770 can be removed from the gap 59 between the bracket 18 and the outer frame 14. Next, as illustrated in FIG. 7L, the inner frame 12 is depressed so that the inner frame 12 and the outer frame 14 are in the unlocked configuration, and the lace adjuster 10 is moved away from the shoe 772.

Figure 8A:
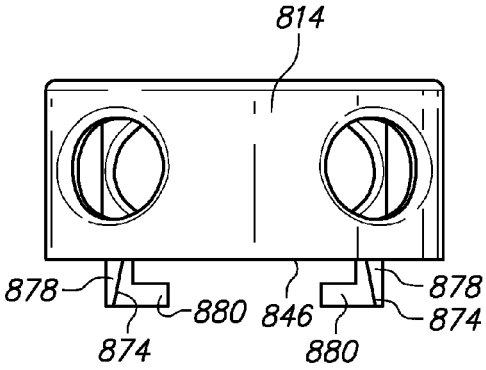
FIGS. 8A and 8B are alternative views of another embodiment of an outer frame of a lace adjuster 810 having features of the present invention.
Figure 8B:
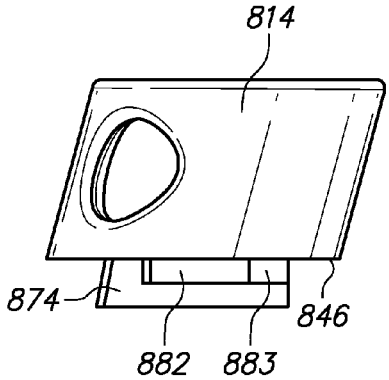
Figure 8C:
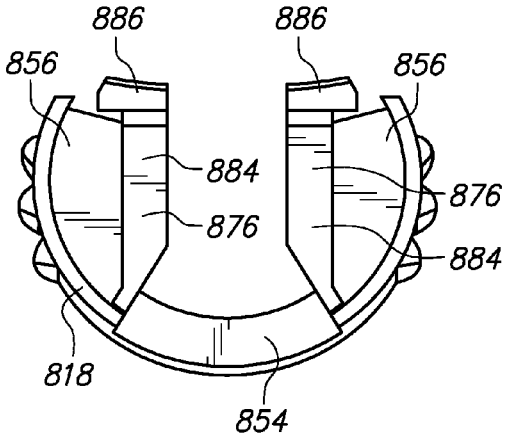
FIGS. 8C and 8D are alternative views of another embodiment of a bracket of the lace adjuster 810 of FIGS. 8A and 8B.
Figure 8D:
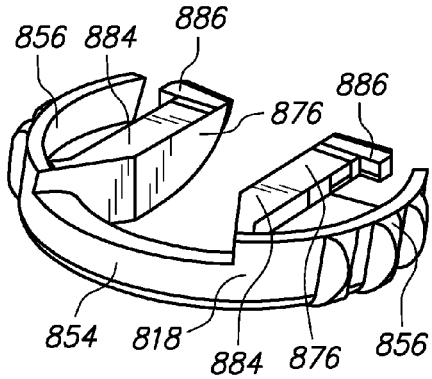

FIGS. 8A and 8B are alternative views of another embodiment of an outer frame of a lace adjuster 810, and FIGS. 8C and 8D are alternative views of another embodiment of a bracket of a lace adjuster 810 having features of the present invention. In this embodiment, an inner frame, a resilient member, a guide system and a cover are not illustrated. However, these components can function in a similar fashion to the corresponding components described above in the embodiment illustrated in FIGS. 1A-1H. Further, the lace adjuster 810 of this embodiment can be designed without the guide system and/or without the cover.

In embodiment illustrated in FIGS. 8A-8D, the lace adjuster 810 includes an outer frame 814 and a bracket 818 that are somewhat similar to the corresponding components described above. However, an attachment system 820 attaches the bracket 818 to the outer frame 814 in a somewhat different fashion. More specifically, in this embodiment, the outer frame 814 includes a pair of attacher tracks 874, and the bracket 818 defines a pair of attacher rails 876 that are adapted to receive the pair of attacher tracks 874 of the outer frame 814. With this design, the bracket 818 can slide relative to the outer frame 814.

More particularly, as illustrated in FIGS. 8A and 8B, each of the pair of attacher tracks 874 is substantially "L" shaped when viewed from a front perspective (as shown in FIG. 8A), with a vertical section 878 that cantilevers down from the bottom side 846 of the outer frame 814, and a horizontal section 880 that extends inwardly from the end of the vertical section 878. Additionally, when viewed from a side perspective (as shown in FIG. 8B), the attacher tracks 874 are substantially "U" shaped and are connected to the bottom side 846 of the outer frame 814 only at either end of the attacher tracks 874. The attacher tracks 874 define an opening 882 between the ends that are connected to the bottom side 846 of the outer frame 814. The attacher tracks 874 further include a locking mechanism 883 positioned toward the back of the attacher tracks 874.

Additionally, as illustrated in FIGS. 8C and 8D, each of the pair of attacher rails 876 is substantially "L" shaped with a front segment 884 that extends horizontally backward from near the front section 854 of the bracket 818, and a rear segment 886 that extends outward horizontally from the end of the front segment 884 away from the front section 854 of the bracket 818.

Figure 8E:
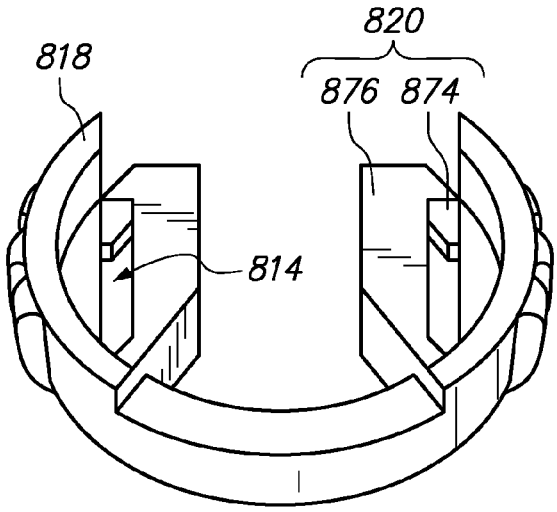
FIGS. 8E-8G are alternative views of another embodiment of an attachment system of the lace adjuster of FIGS. 8A-8D.
Figure 8F:
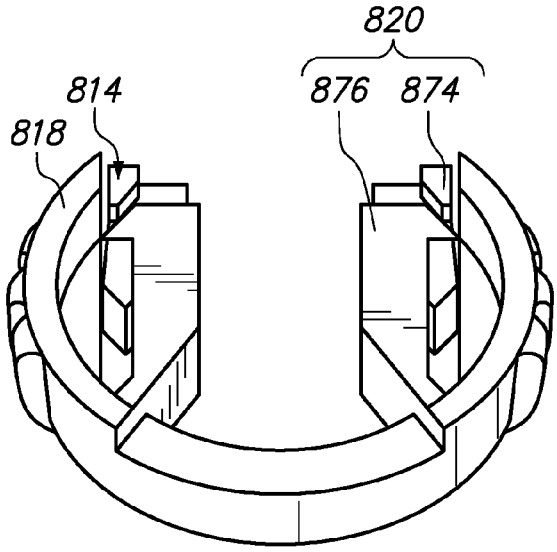
Figure 8G:
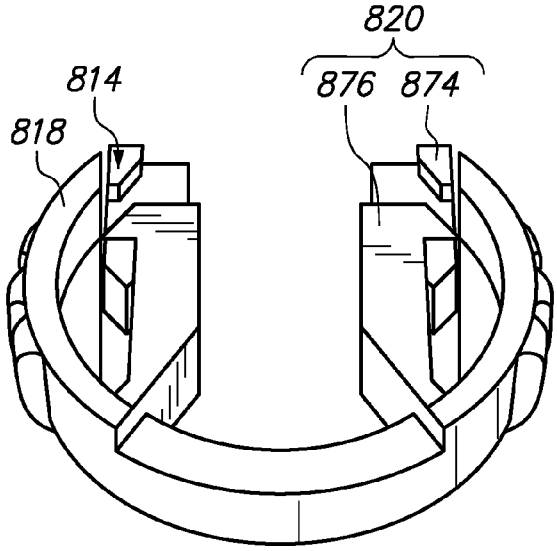

FIGS. 8E-8G are alternative views of another embodiment of an attachment system 820 of the lace adjuster 810 of FIGS. 8A-8D. More particularly, FIGS. 8E-8G illustrate the interaction between the attacher tracks 874 and the attacher rails 876 that form the attachment system 820 of this embodiment. Initially, the attacher tracks 874 are positioned so that the horizontal section 880 of the attacher tracks 874 extends underneath and engages the front segment 884 of the attacher rails 876, with the locking mechanism 883 positioned to engage the rear segment 886 of the attacher rails 876 to effectively lock the attacher tracks 874 relative to the attacher rails 876, with the bracket 818 in the closed configuration. The side sections 856 are then deformed and flexed inwardly so that the locking mechanism 883 can be disengaged from the rear segment 886 of the attacher rails 876. Then the bracket 818 can be slid forward relative to the outer frame 814, with the rear segment 886 of the attacher rails 876 adapted to be positioned within the opening 882 of the attacher tracks 874. The positioning of the rear segment 886 of the attacher rails 876 within the opening 882 of the attacher tracks 874 sets the limits on the extent of movement of the bracket 814 as the bracket 814 moves between the closed configuration and the open configuration.

It should be noted that the bracket 18 can be slidably attached to the outer frame 14 in a fashion that is somewhat different than that illustrated in the embodiments herein.

While the particular embodiments of lace adjusters 10 as shown and disclosed herein are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A lace adjuster for selectively adjusting and securing a shoelace of a shoe, the shoelace including a first end and a second end, the lace adjuster comprising:

an inner frame having a first inner frame aperture and a spaced apart second inner frame aperture;

an outer frame that receives at least a portion of the inner frame, the outer frame having a first outer frame aperture and a spaced apart second outer frame aperture;

a resilient member that is secured to the inner frame and the outer frame, the resilient member allowing the inner frame and the outer frame to move relative to each other between an unlocked configuration and a locked configuration, wherein the first inner frame aperture and the first outer frame aperture are substantially aligned with each other when the inner frame and the outer frame are in the unlocked configuration, wherein the second inner frame aperture and the second outer frame aperture are substantially aligned with each other when the inner frame and the outer frame are in the unlocked configuration, wherein the first inner frame aperture and the first outer frame aperture are not aligned when the inner frame and the outer frame are in the locked configuration, wherein the second inner frame aperture and the second outer frame aperture are not aligned when the inner frame and the outer frame are in the locked configuration, the first inner frame aperture and the first outer frame aperture being adapted to receive the first end of the shoelace, and the second inner frame aperture and the second outer frame aperture being adapted to receive the second end of the shoelace; and a bracket that is movable between a closed configuration and an open configuration, wherein the bracket is adapted to receive a portion of the shoelace when the bracket is in the open configuration, and wherein the bracket is adapted to retain a portion of the shoelace when the bracket is in the closed configuration.

2. The lace adjuster of claim 1 wherein the inner frame includes a third inner frame aperture and a spaced apart fourth inner frame aperture and the outer frame includes a third outer frame aperture and a spaced apart fourth outer frame aperture, wherein the third inner frame aperture and the third outer frame aperture are substantially aligned with each other when the inner frame and the outer frame are in the unlocked configuration, wherein the third inner frame aperture and the third outer frame aperture are not aligned when the inner frame and the outer frame are in the locked configuration, wherein the fourth inner frame aperture and the fourth outer frame aperture are substantially aligned with each other when the inner frame and the outer frame are in the unlocked configuration, wherein the fourth inner frame aperture and the fourth outer frame aperture are not aligned when the inner frame and the outer frame are in the locked configuration, the third inner frame aperture and the third outer frame aperture being adapted to receive the first end of the shoelace, and the fourth inner frame aperture and the fourth outer frame aperture being adapted to receive the second end of the shoelace.

3. The lace adjuster of claim 1 wherein the first end of the shoelace is threaded through the first inner frame aperture and the first outer frame aperture when the inner frame and the outer frame are in the unlocked configuration, and wherein the first end of the shoelace is inhibited from being moved within the first inner frame aperture and the first outer frame aperture when the inner frame and the outer frame are in the locked configuration.

4. The lace adjuster of claim 1 wherein the second end of the shoelace is threaded through the second inner frame aperture and the second outer frame aperture when the inner frame and the outer frame are in the unlocked configuration, and wherein the second end of the shoelace is inhibited from being moved within the second inner frame aperture and the second outer frame aperture when the inner frame and the outer frame are in the locked configuration.

5. The lace adjuster of claim 1 wherein a gap is defined between the bracket and the outer frame, wherein a portion of the shoelace can be inserted into or removed from the gap when the bracket is in the open configuration, and wherein a portion of the shoelace is retained within the gap when the bracket is in the closed configuration.

6. The lace adjuster of claim 5 further comprising an attachment system that slidably attaches the bracket to the outer frame to allow the bracket to move between the closed configuration and the open configuration relative to the outer frame.

7. The lace adjuster of claim 6 wherein the attachment system includes a pair of attacher slots, a pair of attacher apertures, and a pair of attachment pins, and wherein each of the pair of attachment pins extends through one of the attacher slots and one of the attacher apertures to slidably attach the bracket to the outer frame.

8. The lace adjuster of claim 7 wherein the outer frame includes the pair of attacher slots and the bracket includes the pair of attacher apertures.

9. A shoe comprising a shoe lace and the lace adjuster of claim 1.

10. An apparatus for selectively securing a shoelace of a shoe, the apparatus comprising:

an inner frame;

an outer frame that receives at least a portion of the inner frame;

a resilient member that is secured to the inner frame and the outer frame, the resilient member allowing the inner frame and the outer frame to move relative to each other; and a bracket that is movable between a closed configuration and an open configuration, wherein the bracket is adapted to receive a portion of the shoelace when the bracket is in the open configuration, and wherein the bracket is adapted to retain a portion of the shoelace when the bracket is in the closed configuration.

11. The apparatus of claim 10 further comprising an attachment system that slidably attaches the bracket to the outer frame to allow the bracket to move between the closed configuration and the open configuration relative to the outer frame.

12. The apparatus of claim 11 wherein the attachment system includes a pair of attacher slots, a pair of attacher apertures, and a pair of attachment pins, and wherein each of the pair of attachment pins extends through one of the attacher slots and one of the attacher apertures to slidably attach the bracket to the outer frame.

13. The apparatus of claim 10 wherein a gap is defined between the bracket and the outer frame, wherein a portion of the shoelace can be inserted into or removed from the gap when the bracket is in the open configuration, and wherein a portion of the shoelace is retained within the gap when the bracket is in the closed configuration.

14. The apparatus of claim 10 wherein the inner frame and the outer frame move relative to each other between an unlocked configuration and a locked configuration, and wherein the inner frame includes a first inner frame aperture and a second inner frame aperture and the outer frame includes a first outer frame aperture and a second outer frame aperture, the first inner frame aperture and the first outer frame aperture being substantially aligned with each other when the inner frame and the outer frame are in the unlocked configuration, the second inner frame aperture and the second outer frame aperture being substantially aligned with each other when the inner frame and the outer frame are in the unlocked configuration, the first inner frame aperture and the first outer frame aperture not being aligned with each other when the inner frame and the outer frame are in the locked configuration, and the second inner frame aperture and the second outer frame aperture not being aligned when the inner frame and the outer frame are in the locked configuration.

15. The apparatus of claim 14 wherein the shoelace is threaded through the first inner frame aperture and the first outer frame aperture when the inner frame and the outer frame are in the unlocked configuration, and wherein the shoelace is inhibited from being moved within the first inner frame aperture and the first outer frame aperture when the inner frame and the outer frame are in the locked configuration.

16. A shoe comprising a shoe lace and the apparatus of claim 10.

17. A method for selectively adjusting and securing a shoelace of a shoe, the shoelace including a first end and a second end, the method comprising the steps of:

providing an inner frame having a first inner frame aperture and a spaced apart second inner frame aperture;

providing an outer frame that receives at least a portion of the inner frame, the outer frame having a first outer frame aperture and a spaced apart second frame aperture;

securing the inner frame to the outer frame with a resilient member;

moving the inner frame and the outer frame relative to each other between an unlocked configuration and a locked configuration, wherein the first inner frame aperture and the first outer frame aperture are substantially aligned with each other when the inner frame and the outer frame are in the unlocked configuration, wherein the first inner frame aperture and the first outer frame aperture are not aligned when the inner frame and the outer frame are in the locked configuration, wherein the second inner frame aperture and the second outer frame aperture are substantially aligned with each other when the inner frame and the outer frame are in the unlocked configuration, wherein the second inner frame aperture and the second outer frame aperture are not aligned when the inner frame and the outer frame are in the locked configuration, the first inner frame aperture and the first outer frame aperture being adapted to receive the first end of the shoelace, and the second inner frame aperture and the second outer frame aperture being adapted to receive the second end of the shoelace;

slidably attaching a bracket to the outer frame with an attachment system; and moving the bracket relative to the outer frame between a closed configuration and an open configuration, wherein the bracket is adapted to receive a portion of the shoelace when the bracket is in the open configuration, and wherein the bracket is adapted to retain a portion of the shoelace when the bracket is in the closed configuration.

18. The method of claim 17 further comprising the steps of threading the first end of the shoelace through the first inner frame aperture and the first outer frame aperture when the inner frame and the outer frame are in the unlocked configuration, and inhibiting movement of the first end of the shoelace within the first inner frame aperture and the first outer frame aperture when the inner frame and the outer frame are in the locked configuration.

19. The method of claim 17 further comprising the steps of threading the second end of the shoelace through the second inner frame aperture and the second outer frame aperture when the inner frame and the outer frame are in the unlocked configuration, and inhibiting movement of the second end of the shoelace within the second inner frame aperture and the second outer frame aperture when the inner frame and the outer frame are in the locked configuration.

* * * * *